US007621768B2

(12) United States Patent
Suzuki et al.

(10) Patent No.: US 7,621,768 B2
(45) Date of Patent: Nov. 24, 2009

(54) SPACE SAVING MINIATURE CONNECTOR FOR ELECTRIC DEVICES

(75) Inventors: Masayuki Suzuki, Tokyo (JP); Yuuki Nakano, Tokyo (JP)

(73) Assignee: DDK Ltd., Tokyo (JP)

( * ) Notice: Subject to any disclaimer, the term of this patent is extended or adjusted under 35 U.S.C. 154(b) by 22 days.

(21) Appl. No.: 11/915,322

(22) PCT Filed: Apr. 24, 2006

(86) PCT No.: PCT/JP2006/308565

§ 371 (c)(1),
(2), (4) Date: Nov. 21, 2007

(87) PCT Pub. No.: WO2006/126359

PCT Pub. Date: Nov. 30, 2006

(65) Prior Publication Data

US 2009/0047836 A1 Feb. 19, 2009

(30) Foreign Application Priority Data

May 24, 2005 (JP) ..... 2005-150527
Oct. 6, 2005 (JP) ..... 2005-294064

(51) Int. Cl.
*H01R 13/15* (2006.01)
*H01R 13/62* (2006.01)

(52) U.S. Cl. ..... 439/260

(58) Field of Classification Search ..... 439/260, 439/259, 261, 267, 492, 493, 494, 495
See application file for complete search history.

(56) References Cited

U.S. PATENT DOCUMENTS 6,726,497 B2 * 4/2004 Nogawa et al. ..... 439/260

(Continued)

FOREIGN PATENT DOCUMENTS

| | | | |
|---|---|---|---|
| JP | 58-34715 | Y2 | 8/1983 |
| JP | 10-241803 | A | 9/1998 |
| JP | 2000-106238 | A | 4/2000 |
| JP | 2002-270290 | A | 9/2002 |
| JP | 2004-71160 | A | 3/2004 |
| JP | 2004-158280 | A | 6/2004 |

OTHER PUBLICATIONS

International Search Report dated Jul. 11, 2006 for International Application No. PCT/JP2006/308565.

*Primary Examiner*—Chandrika Prasad
(74) *Attorney, Agent, or Firm*—Sughrue Mion, PLLC; Pavel I. Pogodin

(57) ABSTRACT

The invention has an object to provide a connector 10 which achieves a reduced overall height of the order of 1.0 mm and space-saving substrate (in the inserting direction of a circuit board) and which obtains stable connection with a slight operating force and does not cause any defective connection even if a connecting object is accidentally subjected to an external force. The object is accomplished by a connector comprising substantially H-shaped contacts 14 each including a first piece 28 having a contact portion 32 and a pressure receiving portion 34, a second piece 30 having a contact portion 32 and a connection portion 36, and a jointing portion 38 connecting these first and second pieces, and further including holding device permitting pushing portions 48 of a pivoting member 16 to pivotally move between the pressure receiving portions 34 and the connection portions 36, a housing 12 having a ceiling portion 20 formed at least at both ends with protection walls 22 for preventing the ceiling portion 20 from being upwardly deformed when the connecting object is accidentally forced upwardly, and the pivoting member 16 including the pushing portions 48, anchoring holes 50 independently from one another and an actuating portion 46 which is pivotally moved toward a fitting opening 18 of the housing 12 to bring the contact portions 32 of the contacts 14 into contact with the connecting object.

12 Claims, 11 Drawing Sheets

U.S. PATENT DOCUMENTS 6,755,682 B2 * 6/2004 Kunishi et al. ..... 439/495
7,044,773 B2 * 5/2006 Suzuki et al. ..... 439/260
7,137,838 B2 * 11/2006 Koga ..... 439/260
7,255,584 B2 * 8/2007 Takashita ..... 439/260
7,275,948 B2 * 10/2007 Miura et al. ..... 439/260
7,341,477 B2 * 3/2008 Kato ..... 439/495
7,393,239 B2 * 7/2008 Suzuki et al. ..... 439/495
7,435,122 B2 * 10/2008 Suzuki et al. ..... 439/260

* cited by examiner (A)

(B)

(A)

(B)

SPACE SAVING MINIATURE CONNECTOR FOR ELECTRIC DEVICES

TECHNICAL FIELD

This invention relates to a connector for use in electric and electronic appliances such as mobile appliances and the like, and more particularly to a connector which achieves stable electrical connection with a connecting object such as a flexible printed circuit board or flexible flat cable and minimization of area occupied by a substrate.

BACKGROUND ART

Connectors for use in mobile phones, CCD cameras (charge coupled device cameras) and the like are very thin in overall height and have extremely narrow pitches (so-called lighter and more compact). Such connectors each mainly comprise a housing, contacts and slider to embrace a flexible printed circuit board or flexible flat cable between the housing and the slider. Various methods may be considered for holding a flexible printed circuit board or flat cable by the housing and the slider. There are many constructions that after a flexible printed circuit board or flat cable has been inserted into a housing, a slider is inserted into the housing to push the circuit board or cable against the contacts.

The housing is provided with a required number of inserting holes for inserting the contacts and a fitting opening for inserting a flexile printed circuit board or flexible flat cable.

Each of the contacts is substantially U-shaped and mainly comprises a contact portion adapted to contact the circuit board or flat cable, a connection portion to be connected to a substrate or the like, and a fixed portion to be fixed to the housing. The contacts are fixed to the housing by press-fitting or the like.

For example, the slider is substantially in the form of a wedge. The slider is inserted into the housing after the flexible printed circuit board or flexible flat cable has been inserted into the housing with the required number of contacts installed. Such a slider mainly comprises a mounting portion to be mounted on the housing and pushing portions for pushing the circuit board or flat cable against the contact portions of the contacts. The slider is temporarily inserted into the housing, prior to the insertion of the circuit board or flat cable. After the insertion of the circuit board or flat cable, the slider is inserted into the housing again so that the pushing portions of the slider are positioned in parallel with the circuit board or flat cable to cause the circuit board or flat cable to be pushed against the contact portions of the contacts.

Other than these, there have been constructions for bringing contacts into contact with a connecting object such as a flexible printed circuit board or the like by the use of a pivoting member or the like as disclosed in the following patent literatures.

Patent Literature 1; Japanese Patent Application Opened No. 2002-270,290

Patent Literature 2; Japanese Patent Application Opened No. 2000-106,238

Patent Literature 3; Japanese Patent Application Opened No. 2004-71,160

According to the abstract of the Patent Literature 1, the Japanese Patent Application Opened No. 2002-270,290, this invention has an object to provide a reduced overall height connector having an actuator which is actuated by a slight operating force and capable of enlarging moving distances of contacts to securely perform electrical connection. Disclosed is a connector comprising an actuator having cam portions and an actuating portion, between both the portions being formed with relief grooves into which tips of spring portions of the contacts are inserted and removed, so that when the actuator is rotated about its fulcrum through 90° in a clockwise direction, the cam portions cause the spring portions and connecting spring portions of the respective contacts to be elastically deformed to embrace a flexible printed circuit board between projections of the contact portions, with the result that patterns of the flexible printed circuit board are connected to a printed substrate through terminals of the contacts, and an insulator having a ceiling portion covering the contact portions of the respective contacts and formed in the lower portion of the front side of the ceiling portion with a guide portion for inserting the flexible printed circuit board into the connector.

By the way, claim 1 of the Patent Literature 1 recites a connector including contacts, an insulator holding said contacts, and an actuator rotatably mounted on said insulator and enabling said contacts to be elastically deformed to bring them into contact with a connecting object, wherein said contacts each comprise a first beam having on one side a contact portion adapted to contact said connecting object and on the other side an actuated portion to be actuated by said actuator, a second beam having on one side a contact portion adapted to contact said connecting object and on the other side a terminal portion to be connected to a printed substrate, and a jointing spring portion connecting said first and second beams, and wherein said insulator includes a ceiling portion for covering at least ones of the contact portions from the fitting side and said ceiling portion is formed with a guide portion for guiding the insertion of said connecting object. Claim 2 recites the connector having said contacts whose at least ones of the contact portions are each provided with an inclined portion inclined toward said connecting object in the proximity of said jointing spring portion. Claim 3 recites the connector having said actuator comprising an actuating portion, cam portions for actuating said actuated portions of said contacts, and relief grooves between said actuating portion and said cam portions so that said actuated portions can be inserted into said relief grooves before the connector is connected to said connecting object. Claim 4 recites a connector including contacts, an insulator holding said contacts, and an actuator rotatably mounted on said insulator and enabling said contacts to be elastically deformed to bring them into contact with a connecting object, wherein said contacts each comprise a first beam having on one side a contact portion adapted to contact said connecting object and on the other side an actuated portion to be actuated by said actuator, a second beam having on one side a contact portion adapted to contact said connecting object and on the other side a terminal portion to be connected to a printed substrate, and a jointing spring portion connecting said first and second beams, and wherein the contact portions of said first beams each include a first protrusion and a second protrusion arranged side by side in the inserting direction of said connecting object and extending toward said connecting object, and the contact portions of said second beams each include a third protrusion and a fourth protrusion arranged side by side in the inserting direction of said connecting object and extending toward said connecting object so that said third protrusion is positioned between said first protrusion and said second protrusion or said first protrusion is positioned between said third protrusion and said fourth protrusion with the result that said first and second protrusions or said third and fourth protrusions become the contacts contacting said connecting object.

According to the abstract of the Patent Literature 2, the Japanese Patent Application Opened No. 2000-106,238, this invention has an object to provide a connector for a cable, which requires only a slight operating force even if there are many conductors of the cable. Disclosed in the Patent Literature 1 is a connector for a cable comprising contacts each having a contact portion facing to one surface of a cable and a pivot portion facing to the other surface of the cable, and an actuating element adapted to press the cable against the contact portions of the contacts and having cam portions positioned between the pivot portions and the cable and holes into which the pivot portions are inserted with clearances, the pivot portions each having a recess corresponding to the cam portion so that the actuating element is adapted to engage the pivot portions in a manner that the actuating element is pivotally movable about the cam portions.

By the way, claim 1 of the Patent Literature 2, the Japanese Patent Application Opened No. 2000-106,238 recites that in a connector for a cable including contacts each having a contact portion facing to one surface of said cable and a pivot portion facing to the opposite surface of the cable, an insulator for holding said contacts, and an actuating element for pressing the cable against the contact portions of said contacts, said actuating element includes cam portions positioned between the pivot portions and the cable and holes into which said pivot portions are inserted with clearances, respectively, and said pivot portions each having a recess corresponding to said cam portion so that said actuating element is adapted to engage the pivot portions in a manner that the actuating element is pivotally movable about the cam portions. Claim 2 recites that in the connector for a cable claimed in claim 1 said insulator includes anchoring portions adapted to engage said actuating element to hold said actuating element under the condition that said cam portions are spaced apart from said contact portions of the contacts when the cable has not been connected to the connector. Claim 3 recites that in the connector for a cable claimed in claim 1 said cable is a flat cable, and said insulator includes cable anchoring grooves for receiving side edges of the flat plate-shaped cable to prevent the cable from moving in the direction of its thickness when the cable has been connected to the connector. Claim 4 recites that in a connector obtaining electrical connection between contacts and a cable in a manner that one surface of the cable faces to the contact portions of the contacts and the opposite surface of the cable is pushed against the contact portions by the rotational actuating element, said contact portions each provided with at least two contact side projections, while said actuating element is provided with actuating element side projections corresponding to spaces between said contact side projections. Claim 5 recites the connector for a cable including said contacts each having a pivot portion facing to the opposite surface of the cable and said actuating element having cam portions between the pivot portions and the cable, said cam portions each provided with said actuating element side projection.

According to the abstract of the Patent Literature 3, the Japanese Patent Application Opened No. 2004-71,160, this invention has an object to provide a connector capable of securely pushing a flexible printed circuit board or flexible flat cable to contact portions of contacts by means of a slider without degrading strength of respective members and specifications or customers demands, and achieving a superior operationality, narrower pitches of conductors and reduced overall height. This connector comprises contacts each comprising a contact portion, a connection portion, and an elastic portion and a fulcrum portion between the contact portion and the connection portion, and a pressure receiving portion extending from the elastic portion in a position facing to the connection portion, and the contact portion, elastic portion, fulcrum portion and connection portion being arranged in the form of a crank, and a slider comprising pushing portions arranged continuously in the longitudinal direction and the slider being pivotally mounted on a housing so that the pushing portions are pivotally moved in a space between the connection portions and pressure receiving portions of the contacts.

Claim 1 of the Patent Literature 3, the Japanese Patent Application Opened No. 2004-71,160 recites a connector detachably fitted with a flexible printed circuit board or flexible flat cable, including a required number of contacts each having a contact portion adapted to contact said flexible printed circuit board or flexible flat cable, a housing holding and fixing the contacts and having a fitting opening for inserting the flexible printed circuit board or flexible flat cable, and a slider for pushing the flexible printed circuit board or flexible flat cable to the contacts, wherein the contacts each comprise an elastic portion and a fulcrum portion between the contact portion and a connection portion, and a pressure receiving portion extending from the elastic portion and located in a position facing to the connection portion, and the contact portion, elastic portion, fulcrum portion and connection portion being arranged substantially in the form of a crank, and the slider is provided with pushing portions continuously arranged in its longitudinal direction and is mounted on the housing so that the pushing portions are pivotally moved in a space between the connection portions and pressure receiving portions of the contacts. Claim 2 recites a connector detachably fitted with a flexible printed circuit board or flexible flat cable, including a required number of contacts each having a contact portion adapted to contact said flexible printed circuit board or flexible flat cable, a housing holding and fixing the contacts and having a fitting opening for inserting the flexible printed circuit board or flexible flat cable, and a slider for pushing the flexible printed circuit board or flexible flat cable to the contacts, wherein two kinds of contacts are arranged alternately staggered, the contacts of one kind each comprising an elastic portion and a fulcrum portion between the contact portion and a connection portion, and a pressure receiving portion extending from the elastic portion in a position facing to the connection portion, and the contact portion, elastic portion, fulcrum portion and connection portion being arranged substantially in the form of a crank, and the contacts of the other kind each comprising an elastic portion and a fulcrum portion between the contact portion and a connection portion, and a pressure receiving portion extending in the opposite direction of the contact portion, and the contact portion, elastic portion, fulcrum portion, and connection portion being arranged substantially in the form of a U-shape, and the slider is provided with pushing portions arranged continuously in its longitudinal direction and mounted on the housing so that the pushing portions are pivotally moved in a space between the connection portions and the pressure receiving portions of the contacts of the one kind and between the pressure receiving portions of the contacts of the other kind and the housing. Claim 3 recites that when the pushing portions of the slider are pivotally moved in the space between the connection portions and the pressure receiving portions of the contacts of the one kind, the pressure receiving portions are raised by the pushing portions so that the elastic portions are tilted about the fulcrum portions toward the contact portions to push the contact portions against the flexible printed circuit board or flexible flat cable. Claim 4 recites that the pressure receiving portions of the contacts of the one kind or the other kind are each provided with a projection so that the pushing portions of the slider are prevented from moving toward the connection portions of the contacts of the one kind. Claim 5 recites that the pushing portions of the slider are of an elongated shape. Claim 6 recites that the slider is formed with a required number of anchoring holes independent from one another, which are adapted to engage the projections of the contacts, respectively. Claim 7 recites the elongated pushing portions being in the form of an ellipsoid. Claim 8 recites a connector having contacts of the one kind each provided with a further contact portion at a location extending from the fulcrum portion and adapted to contact the flexible printed circuit board or flexible flat cable. Claim 9 recites that a connector having contacts of the other kind each provided with an extension portion extending from the fulcrum in the opposite direction of the connection portion, and having the slider mounted on the housing so that the pushing portions of the slider are pivotally moved in the space between the extension portions and the pressure receiving portions. Claim 10 recites a connector having the contacts of the other kind each further provided between the fulcrum portion and the connection portion with a contact portion adapted to contact the flexible printed circuit board or flexible flat cable.

DISCLOSURE OF THE INVENTION

Task to be Solved by the Invention

In recent years, with the miniaturization of the electric and electronic appliances, the requirements for more miniaturization, reduced overall height and space saving of the connectors of these kinds have become stronger. As the connectors of these kinds for connecting flexible printed circuit boards or flat cables, there are the connectors described above, the connectors of the Patent Literatures 1 and 3 (the pivoting member such as the actuator is rotated on the rear side (on the opposite side of the fitting opening) to connect the connector to a connecting object), and the connector of the Patent Literature 2 (the pivoting member such as the actuator is rotated on the front side (on the side of the fitting opening) to connect the connector to a connecting object).

With the front locking type connector disclosed in the Patent Literature 2, since the pivoting member is rotated on the side of the fitting opening, it is impossible to arrange the contacts above and below, and makes it difficult to achieve a reduced overall height (height of the order of 1 mm). With this type of connector, moreover, it is difficult to guide a connecting object because the actuator is under the opened condition (there is no wall on the ceiling side) when the connecting object is inserted into the connector.

With the rear locking type connectors disclosed in the Patent Literatures 1 and 3, on the other hand, since the pivoting member such as the actuator is rotated on the opposite side of the fitting opening, when the connecting object such as the flexible printed circuit board is connected to the connector, part of the pivoting member extends from one end face of the connector to form a dead space for a substrate, thereby making impossible to save the space of the substrate in the inserting direction of the connecting object.

Moreover, the connectors disclosed in the Patent Literatures 1 and 3 have the following disadvantages.

In the structure disclosed in the Patent Literature 1, the cam portions of the actuator are rotated about a single point as a fulcrum point so that the cam portions could not rotate in a compact manner and more reduced overall height of the connector is impossible. There are further problems that yielding or deterioration of the springs and increase in locking force could not be prevented, and clockwise turning moment of the cam portions could not be securely stopped.

In the structure disclosed in (FIGS. 2 and 6 of) the Patent Literature 3, since the fitting opening includes a chamfered or tapered surface on the side of the insertion of the connecting object, the housing and hence the contacts are likely to be forced upwardly upon the connecting object being accidentally subjected to external forces upwardly (viewed in the drawings) so that stable contact force could not be obtained (particularly it is acute in case using contacts on lower side), thereby resulting into defective or failed connection. When the connector with an actuator or pivoting member being rotated on the side opposite to the fitting opening is miniaturized or its overall height is reduced, the connecting object becomes likely to be accidentally subjected to external forces so that the problem described above becomes important. The same holds true in the connector disclosed in the Patent Literature 1.

As can be seen from the above descriptions, with the front locking type connector disclosed in the Patent Literature 2, a miniaturization of the connector, narrower pitches, and a minimization of space in inserting direction (about 3 mm) can be realized, but it is difficult to realize a reduced overall height (at the most of the order of 1 mm) and to arrange contacts above and below to comply specifications or requirements of customers. Moreover, it is difficult to ensure stable connection and stable holding force when the connecting object is accidentally forced upwardly, and it is difficult to guide the connecting object. On the other hand, with the connectors disclosed in the Patent Literatures 1 and 3, a miniaturization of the connector, narrower pitches, and a more reduced overall height (of the order of 0.65 mm) can be realized, and the requirement for contacts arranged above and below according to specifications of customers can be fulfilled, while stable connection and stable holding force can be improved in comparison with the connector disclosed in the Patent Literature 2 when the connecting object is forced upwardly, and the connecting object can be readily guided. However, the connectors disclosed in the Patent Literatures 1 and 3 have an disadvantage that the space minimization in the inserting direction is only at the best 3.5 mm.

There are requirements for more reduced overall heights of connectors. Moreover, when a connecting object such as a flexible printed circuit board is accidentally forced upwardly, the holding force for the pivoting member becomes lower due to the direction of rotation of the pivoting member so that the pivoting member is likely to be dislodged, thereby causing defective or failed connections.

In view of the problems of the prior art described above, the object of the invention is to provide a connector which achieves a miniaturization of the connector, narrower pitches, a reduced overall height of the order of 1.0 mm, and a space-saving substrate (particularly in the inserting direction) and obtains stable connection with simple operation and a slight operating force without any failed or defective connection even if a connecting object is accidentally forced by external forces.

Solution For The Task

In order to achieve the object of the invention described above, the first invention is a connector 10 including a plurality of contacts 14 each having two contact portions 32*a* and 32*b* adapted to contact a connecting object, a housing 12 arranging and holding said contacts 14 therein and having at its front portion a fitting opening 18 into which said connecting object is inserted, and a pivoting member 16 causing said contacts 14 to be elastically deformed to push the contacts 14 against said connecting object, wherein said contacts 14 each comprise a first piece 28 having on the side of one end the contact portion 32*a* adapted to contact said connecting object and on the side of the other end a pressure receiving portion 34 adapted to be pushed by said pivoting member 16, a second piece 30 having on the side of one end the further contact portion 32*b* adapted to contact said connecting object and on the side of the other end a connection portion 36 adapted to be connected to a substrate, and a jointing portion 38 for connecting said first and second pieces 28 and 30, and the contact portion 32*a* of said first peace 28, said jointing portion 38, and said connection portion 36 being arranged in the form of a crank, and said contacts 14 further comprise holding means permitting pushing portions 48 of said pivoting member 16 to pivotally move between said pressure receiving portions 34 and said connection portions 36, wherein said housing 12 comprises a ceiling portion 20 for covering the contact portions 32*a* and 32*b* of said contacts 14, and said ceiling portion 20 is provided with protection walls 22 at least at both ends of said ceiling portion 20 for preventing said ceiling portion 20 from being raised when said connecting object is accidentally forced upwardly, and wherein said pivoting member 16 comprises an actuating portion 46 for pivotally moving the pivoting member 16, the pushing portions 48 continuously arranged in the longitudinal direction of said pivoting member 16, and anchoring holes 50 independent from one another for receiving therein said pressure receiving portions 34, respectively, said pivoting member 16 being mounted on said housing 12 so that said pushing portions 48 are pivotally moved between said connection portions 36 and said pressure receiving portions 34 of said contacts 14, during which pivotal movement the axis 54 of rotation of said pushing portions 48 is moved with their pivotal movement to achieve their compact rotation, and said actuating portion 46 of the pivoting member 16 is pivotally moved toward the fitting opening 18 of said housing 12 to bring the contact portions 32*a* and 32*b* of said contacts 14 into contact with said connecting object.

The second invention is a connector 102 including a plurality of contacts 142 each having two contact portions 322*a* and 322*b* adapted to contact a connecting object, a housing 122 arranging and holding said contacts 142 therein and having at its upper portion a fitting opening 182 into which said connecting object is inserted, and a pivoting member 162 causing said contacts 142 to be elastically deformed to push the contacts 142 against said connecting object, wherein said contacts 142 each comprise a first piece 282 having on the side of one end the contact portion 322*a* adapted to contact said connecting object and on the side of the other end a pressure receiving portion 342 adapted to be pushed by said pivoting member 162, a second piece 302 having on the side of one end the further contact portion 322*b* adapted to contact said connecting object and on the side of the other end a connection portion 362 adapted to be connected to a substrate, and a jointing portion 382 for connecting said first and second pieces 282 and 302, and said contacts 142 further comprise holding means permitting pushing portions 482 of said pivoting member 162 to pivotally move between said pressure receiving portions 342 and said connection portions 362, wherein said housing 122 comprises a ceiling portion 202 for covering ones of the contact portions 322*a* and 322*b* of said contacts 142, and wherein said pivoting member 162 comprises an actuating portion 462 for pivotally moving the pivoting member 162, the pushing portions 482 continuously arranged in the longitudinal direction of said pivoting member 162, and anchoring holes 502 independent from one another for receiving therein said pressure receiving portions 342, respectively, said pivoting member 162 being mounted on said housing 122 so that said pushing portions 482 are pivotally moved between said connection portions 362 and said pressure receiving portions 342 of said contacts 142, during which pivotal movement the axis 54 of rotation of said pushing portions 482 is moved with their pivotal movement to achieve their compact rotation, and said actuating portion 462 of the pivoting member 162 is pivotally moved toward the fitting opening 182 of said housing 122 to bring the contact portions 322*a* and 322*b* of said contacts 142 into contact with said connecting object.

The third invention is a connector 10 including a plurality of contacts 14 each having one contact portion 32*a* adapted to contact a connecting object and an extension portion 35, a housing 12 arranging and holding said contacts 14 therein and having at its front portion a fitting opening 18 into which said connecting object is inserted, and a pivoting member 16 causing said contacts 14 to be elastically deformed to push the contacts 14 against said connecting object, wherein said contacts 14 each comprise a first piece 28 having on the side of one end the contact portion 32*a* adapted to contact said connecting object and on the side of the other end a pressure receiving portion 34 adapted to be pushed by said pivoting member 16, a second piece 30 having on the side of one end the extension portion 35 extending in the direction opposite to the inserting direction of said connecting object and on the side of the other end a connection portion 36 adapted to be connected to a substrate, and a jointing portion 38 for connecting said first and second pieces 28 and 30, and the contact portion 32*a* of said first piece 28, said jointing portion 38, and said connection portion 36 being arranged in the form of a crank, and said contacts 14 further comprise holding means permitting pushing portions 48 of said pivoting member 16 to pivotally move between said pressure receiving portions 34 and said connection portions 36, wherein said housing 12 comprises a ceiling portion 20 for covering the contact portions 32*a* of said contacts 14, and wherein said pivoting member 16 comprises an actuating portion 46 for pivotally moving the pivoting member 16, the pushing portions 48 continuously arranged in the longitudinal direction of said pivoting member 16, and anchoring holes 50 independent from one another for receiving therein said pressure receiving portions 34, respectively, said pivoting member 16 being mounted on said housing 12 so that said pushing portions 48 are pivotally moved between said connection portions 36 and said pressure receiving portions 34 of said contacts 14, during which pivotal movement the axis 54 of rotation of said pushing portions 48 is moved with their pivotal movement to achieve their compact rotation, and said actuating portion 46 of the pivoting member is pivotally moved toward the fitting opening 18 of said housing 12 to bring the contact portions 32*a* of said contacts 14 into contact with said connecting object.

The fourth invention is a connector 102 including a plurality of contacts 142 each having one contact portion 322*a* adapted to contact a connecting object and an extension portion 35, a housing 122 arranging and holding said contacts 142 therein and having at its upper portion a fitting opening 182 into which said connecting object is inserted, and a pivoting member 162 causing said contacts 142 to be elastically deformed to push the contacts 142 against said connecting object, wherein said contacts 142 each comprise a first piece 282 having on the side of one end the contact portion 322*a* adapted to contact said connecting object and on the side of the other end a pressure receiving portion 342 adapted to be pushed by said pivoting member 162, a second piece 302 having on the side of one end an extension portion 35 extending in the direction opposite to the inserting direction of said connecting object and on the side of the other end a connection portion 36 adapted to be connected to a substrate, and a jointing portion 382 for connecting said first and second pieces 282 and 302, and said contacts 142 further comprise holding means permitting pushing portions 482 of said pivoting member 162 to pivotally move between said pressure receiving portions 342 and said connection portions 362, wherein said housing 122 comprises a ceiling portion 202 for covering the contact portions 322*a* of said contacts 142, and wherein said pivoting member 162 comprises an actuating portion 46 for pivotally moving the pivoting member 162, the pushing portions 482 continuously arranged in the longitudinal direction of said pivoting member 162, and anchoring holes 50 independent from one another for receiving therein said pressure receiving portions 342, respectively, said pivoting member 162 being mounted on said housing 122 so that said pushing portions 482 are pivotally moved between said connection portions 362 and said pressure receiving portions 342 of said contacts 142, during which pivotal movement the axis 54 of rotation of said pushing portions 482 is moved with their pivotal movement to achieve their compact rotation, and said actuating portion 462 of the pivoting member 162 is pivotally moved toward the fitting opening 182 of said housing 122 to bring the contact portions 322*a* of said contacts 142 into contact with said connecting object.

In the first to fourth inventions, as said holding means it is preferable to provide a projection 40 located on said pressure receiving portion 34 or 342 of said first piece 28 or 282 of at least every other contact 14 or 142 to extend toward said connection portion 36 or 362, and a protrusion 42 provided in the proximity of tip of the connection portion 36 or 362 of said second piece 30 or 302 of the at least every other contact 14 or 142 to extend toward said pressure receiving portion 34 or 342, or it is preferable to provide a raised portion 44 provided between the connection portion 36 or 362 of said second piece 30 or 302 and said jointing portion 38 or 382 of at least every other contact 14 or 142 to extend toward said pressure receiving portion 34 or 342, or it is preferable to alternately arrange contacts 14 or 142 each provided with said projection 40 and said protrusion 42, and contact 14 or 142 each provided with said raised portions 44 so that said projections, said protrusions and said raised portions are alternately staggered.

In the first to fourth invention, it is more preferable to provide an extended portion 39 at the tip of the pressure receiving portion 34 or 342 of said first piece.

Moreover, it is preferable to further form said protection wall 22 at the center of said ceiling portion or over all said ceiling portion.

In the first to fourth invention, preferably said pivoting member 16 or 162 is formed at its longitudinal ends with slits 47 which define plate-shaped pieces 49 having elasticity which each include a raised portion 51 at the end, and at both longitudinal ends of said housing 12 there are provided fixtures 17 each having an extended portion 62 having elasticity formed integrally with or separately from said fixture 17 and extending substantially perpendicular to the ceiling portion 20 of said housing 12 so that when said pivoting member 16 or 162 has been closed, the raised portions 51 of said pivoting member 16 or 162 engage the insides of said extended portions 62, and, in addition, more preferably said fixtures 17 are each provided with an extended piece 60 adapted to come into contact with the upper surface of said pivoting member 16 or 162 when the pivoting member 16 or 162 is opened, thereby limiting the rotating angle of said pivoting member 16 or 162 when said pivoting member 16 or 162 is opened.

In the first to fourth invention, preferably a connecting object such as a flexible printed circuit board 70 or 702 or a flexible flat cable is provided at both longitudinal ends with anchoring portions 72, while said pivoting member 16 or 162 is provided with engaging projections 53 located at positions corresponding to the anchoring portions 72 of said connecting object and adapted to engage said anchoring portions 72 so that when said pivoting member 16 or 162 is closed, said engaging projections 53 engage said anchoring portions 72, thereby holding said connecting object.

Moreover, in the first and third invention, preferably said housing 12 is provided with slits 21 on the side to contact said pivoting member 16 only at locations corresponding to the contacts 14 to be inserted into the housing 12 from the side opposite to the fitting opening 18.

Furthermore, when said connecting object is connected to said connector 10 or 102, preferably the pushing portions 48 or 482 of said pivoting member 16 or 162 are successively positioned such that before connecting said connecting object to said connector 10 or 102, the lower ends of the pushing portions 48 or 482 of said pivoting member 16 or 162 are in contact with said raised portions 44, that, second, when said actuating portion 46 is pivotally moved, the pushing portions 48 or 482 are pivotally moved about centers of curvatures of the lower ends as axes 54 of rotation, respectively, under the condition of the lower ends in contact with said raised portions 44 so that said pushing portions 48 or 482 assume slightly inclined positions, that, third, when said actuating portion 46 is further pivotally moved, the pushing portions 48 or 482 are pivotally moved about centers of said pushing portions 48 or 482 as axes 54 of rotation, respectively, while the lower ends 58 of said pushing portions 48 or 482 somewhat move from the second condition toward said connection portions 36 or 362 so that said pushing portions 48 or 482 assume substantially vertical positions, that, fourth, when said actuating portion 46 is further pivotally moved, said lower ends 58 of the pushing portions 48 or 482 are further moved from the third condition toward said connection portions 36 or 362 and upper ends 56 of said pushing portions 48 or 482 move toward said projections 40 so that said pushing portions 48 or 482 assume vertical positions, that, fifth, when said actuating portion 46 is further pivotally moved, said lower ends 58 further move from the fourth condition toward said connection portions 36 or 362 and the upper ends 56 of said pushing portions 48 or 482 come into contact with said projections 40, and that, finally, when the actuating portion of the pivoting member 16 or 162 is further pivotally moved from the fifth condition, said pushing portions 48 or 482 are pivotally moved about centers of curvatures of said upper ends 56 as axes 54 of rotation, respectively, whereby the contact portions 32*a* or 322*a* and 32*b* or 322*b* of said contacts 14 or 142 are brought into contact with said connecting object by pivotally moving said pivoting member 16 or 162 toward the fitting opening 18 or 182 of said housing 12 or 122.

The connector 10 or 102 performs the following functions. After a connecting object such as a flexible printed circuit board 70 or 702 or flat cable has been inserted into the fitting opening 18 or 182 of said housing 12 or 122, the pushing portions 48 or 482 of the pivoting member 16 or 162 are pivotally moved between the connection portions 36 and the pressure receiving portions 34 of said contacts 14 or 142 to cause said pressure receiving portions 34 to be raised by the pushing portions 48 or 482 so that the jointing portions 38 or 382 of said contacts 14 or 142 are tilted about one end of the jointing portions 38 or 382 toward said contact portions 32 or 322, thereby pushing said contact portions 32 or 322 to the connecting object such as the flexible printed circuit board 70 or 702 or flexible flat cable.

EFFECTS OF THE INVENTION

As can be seen from the above description, the connectors according to the invention can bring about the following significant effects.

(1) according to the first and third invention, a reduced overall height to an extent of the order of 1.0 mm, a miniaturization of the connector and narrower pitches are possible, and a space-saving for a substrate (particularly, to 3.0 mm in length in the inserting direction) can be obtained. As compared with the front locking type and rear locking type connectors of the prior art, according to the invention a locking length more than 2 mm can be ensured, and a stable connection can be obtained with simple operation and slight operating force because the part to be actuated by a finger becomes larger. In addition, according to the first invention, even if a connecting object is accidentally subjected to external forces, failed connection can be prevented as compared with the prior art (stable connection and holding force are more improved in comparison with the prior art as is clear by referring to Tables 1 and 2).

(2) According to the second and fourth inventions, more space-saving for a substrate in the inserting direction can be achieved in comparison with the first and third inventions. As compared with the front locking type and rear locking type connectors of the prior art, a locking length can be assured, and a stable connection can be obtained with a simple operation and slight operating force because the part to be actuated by a finger becomes larger.

(3) According to the invention, said holding means comprises a projection 40 provided on said pressure receiving portion 34 of said first piece 28 of at least every other contact 14 or to extend toward said connection portion 36, and a protrusion 42 provided in the proximity of tip of the connection portion 36 of said second piece 30 of the at least every other contact 14 to extend toward said pressure receiving portion 34. Therefore, said pivoting member 16 can be safely rotated, and as the pivoting member 16 is rotated toward the fitting opening side, the area occupied by the substrate becomes smaller (length in the inserting direction becomes 3.0 mm).

(4) According to the invention, said holding means comprises a raised portion 44 provided between the connection portion 36 of said second piece 30 and said jointing portion 38 of at least every other contact 14 to extend toward said pressure receiving portion 34. Accordingly, said pivoting member 16 can be safely rotated, and as the pivoting member 16 is rotated toward the fitting opening side, the area occupied by the substrate becomes smaller (length in the inserting direction becomes 3.0 mm).

(5) According to the invention, contacts 14 each provided with said projection 40 and said protrusion 42, and contact 14 each provided with said raised portions 44 are alternately arranged so that said projections, said protrusions and said raised portions are alternately staggered. Therefore, said pivoting member 16 can be easily inserted and can be safely rotated, and as the pivoting member 16 is rotated toward the fitting opening side, the area occupied by the substrate becomes smaller (length in the inserting direction becomes 3.0 mm) and a narrow pitch of the connector can be achieved.

(6) As the pressure receiving portion 34 of said first piece 28 is provided at its tip with an extended portion 39, it is possible to prevent the center of said housing 12 from being deformed toward the fitting opening 18 due to reaction force against the pivotal movement of the pivoting member 16.

(7) In the case that in the first invention said protection wall 22 is further provided at the center of said ceiling portion or over all said ceiling portion, even if the connecting object such as a flexible printed circuit board is accidentally forced upwardly by external forces, the housing 12 can be prevented from being raised so that stable contact forces can be obtained and failed connection can be avoided.

(8) In the first to fourth invention, the connector is constructed in a manner that when said connecting object is connected to said connector 10, the pushing portions 48 of said pivoting member 16 are successively positioned such that before connecting said connecting object to said connector 10, the lower ends of the pushing portions 48 of said pivoting member 16 are in contact with said raised portions 44, that, second, when said actuating portion 46 is pivotally moved, the pushing portions 48 are pivotally moved about centers of curvatures of the lower ends as axes 54 of rotation, respectively, under the condition of the lower ends in contact with said raised portions 44 so that said pushing portions 48 assume slightly inclined positions, that, third, when said actuating portion 46 is further pivotally moved, the pushing portions 48 are pivotally moved about centers of said pushing portions 48 as axes 54 of rotation, respectively, while the lower ends 58 of said pushing portions 48 somewhat move from the second condition toward said connection portions 36 so that said pushing portions 48 assume substantially vertical positions, that, fourth, when said actuating portion 46 is further pivotally moved, said lower ends 58 of the pushing portions 48 are further moved from the third condition toward said connection portions 36 and upper ends 56 of said pushing portions 48 move toward said projections 40 so that said pushing portions 48 assume vertical positions, that, fifth, when said actuating portion 46 is further pivotally moved, said lower ends 58 further move from the fourth condition toward said connection portions 36 and the upper ends 56 of said pushing portions 48 come into contact with said projections 40, and that, finally, when the actuating portion of the pivoting member 16 is further pivotally moved from the fifth condition, said pushing portions 48 are pivotally moved about centers of curvatures of said upper ends 56 as axes 54 of rotation, respectively, whereby the contact portions 32*a* and 32*b* of said contacts 14 are brought into contact with said connecting object by pivotally moving said pivoting member 16 toward the fitting opening 18 of said housing 12. Therefore, the pushing portions 48 of said pivoting member 16 are rotated about axis of rotation which is not a fixed axis and moving or displacing so that the pushing portions perform compact rotations, which will contribute to a reduced overall height of the connector 10.

(9) In the first to fourth inventions, said pivoting member 16 is formed at its longitudinal ends with slits 47 which define plate-shaped pieces 49 having elasticity which each include a raised portion 51 at the end, and at both longitudinal ends of said housing 12 there are provided fixtures 17 each having an extended portion 62 having elasticity formed integrally with or separately from said fixture 17 and extending substantially perpendicular to the ceiling portion 20 of said housing 12 so that when said pivoting member 16 has been closed, the raised portions 51 of said pivoting member 16 engage the insides of said extended portions 62. Consequently, even if the connecting object such as a flexible printed circuit board is accidentally forced upwardly or forwardly or rearward by external forces, said pivoting member 16 to be stationary does not pivotally move so that stable connection can be obtained.

(10) Moreover, said fixtures 17 are each provided with an extended piece 60 adapted to come into contact with the upper surface of said pivoting member 16 when the pivoting member 16 is opened, thereby limiting the rotating angle of said pivoting member 16 when said pivoting member 16 is opened. Accordingly, the pivoting member 16 does not rotate to an excessive extent, upon its pivotal movement, and any damage of the pivoting member 16 and housing 12 could not occur.

(11) In the first to fourth invention, said connecting object such as a flexible printed circuit board 70 or flexible flat cable is provided at both longitudinal ends with anchoring portions 72, while said pivoting member 16 is provided with engaging projections 53 located at positions corresponding to the anchoring portions 72 of said connecting object and adapted to engage said anchoring portions 72 so that when said pivoting member 16 is closed, said engaging projections 53 engage said anchoring portions 72, thereby holding said connecting object. Therefore, when the connecting object such as a flexible printed circuit board is inserted into the housing, the connecting object can be securely positioned. Even if the connecting object is accidentally subjected to external forces, the connecting object does not shift its position, thereby obtaining stable connection.

(12) In the first and third invention, said housing 12 is provided with slits 21 on the side to contact said pivoting member 16 only at locations corresponding to the contacts 14 to be inserted into the housing 12 from the side opposite to the fitting opening 18. Accordingly, a more reduced overall height (0.1 mm) of the connector is possible.

DESCRIPTION OF THE REFERENCE NUMERALS

Figure 1:
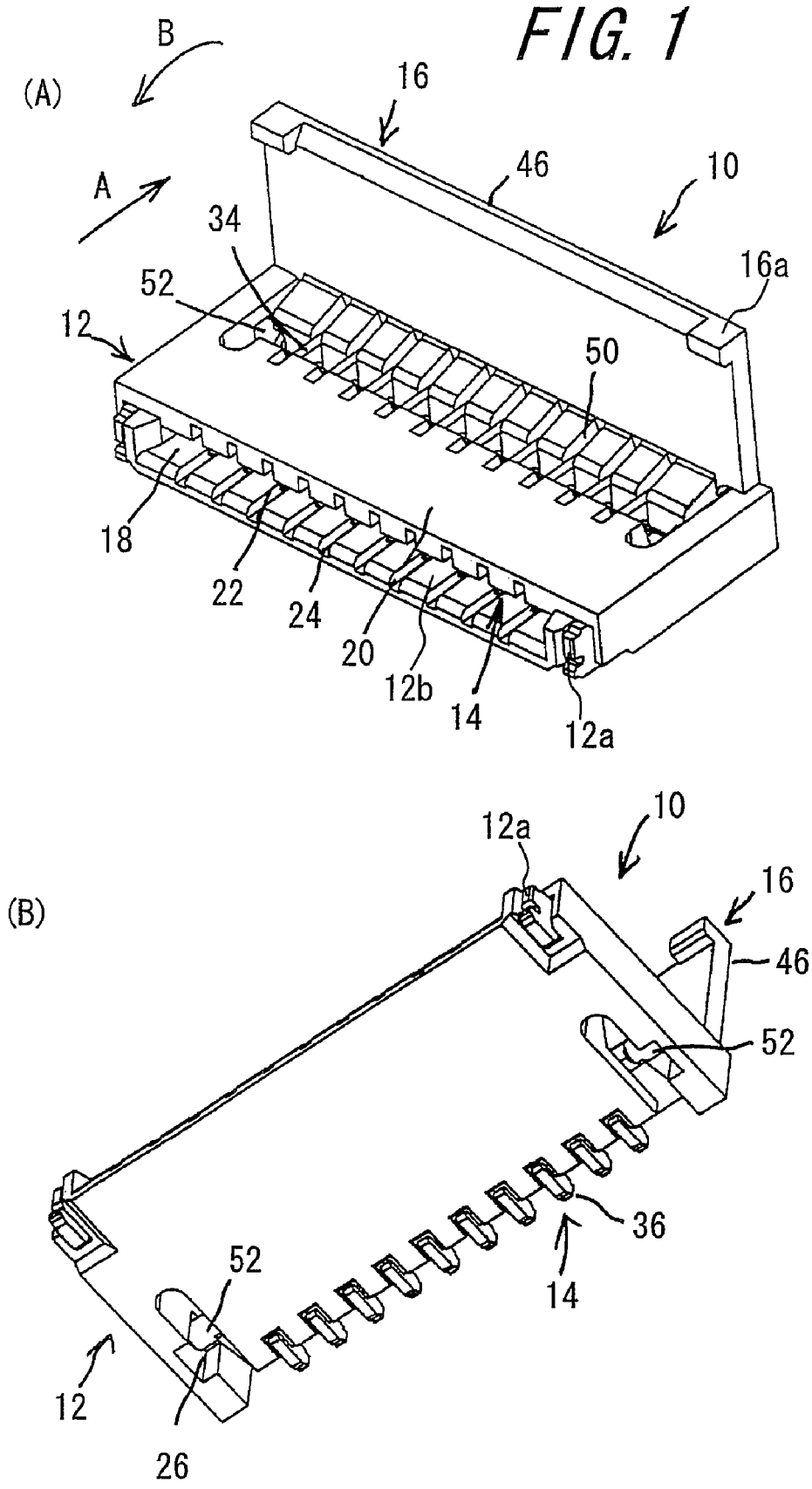
FIG. 1 is a perspective view (A) of the connector according to the invention with its pivoting member opened, viewed from the above on the side of the fitting opening, and a perspective view (B) of the connector with the pivoting member opened, viewed from the side of connection portions.

10, 101, 102 Connector
12, 121, 122 Housing
12*a* Anchoring portion
12*b* Lower face
14, 142 Contact
16, 161, 162 Pivoting member
16*a* Locking portion
17 Fixture
18, 182 Fitting opening
20, 202 Ceiling portion
21 Slit
22 Protection wall
24 Inserting hole
26 Bearing
28, 282 First piece
30, 302 Second piece
32*a*, 32*b*, 322*a*, 322*b* Contact portion
34, 342 Pressure receiving portion
35 Extension portion
36, 362 Connection portion
38, 382 Jointing portion
39 Extended portion
40 Projection
42 Protrusion
44 Raised portion
46 Actuating portion
47 Slit
48, 482 Pushing portion
49 Plate-shaped piece
50 Anchoring hole
51 Raised portion
52 Axle
53 Engaging projection
54 Axis of rotation
56 Upper end
58 Lower end
60 Extended piece
61 Fixed portion
62 Extended portion
70, 702 Flexible printed circuit board
72 Anchoring portion
80 Substrate

BEST MODE FOR CARRYING OUT THE INVENTION

One embodiment of the connector according to the invention will be explained with reference to FIGS. 1 to 5.

Figure 2:
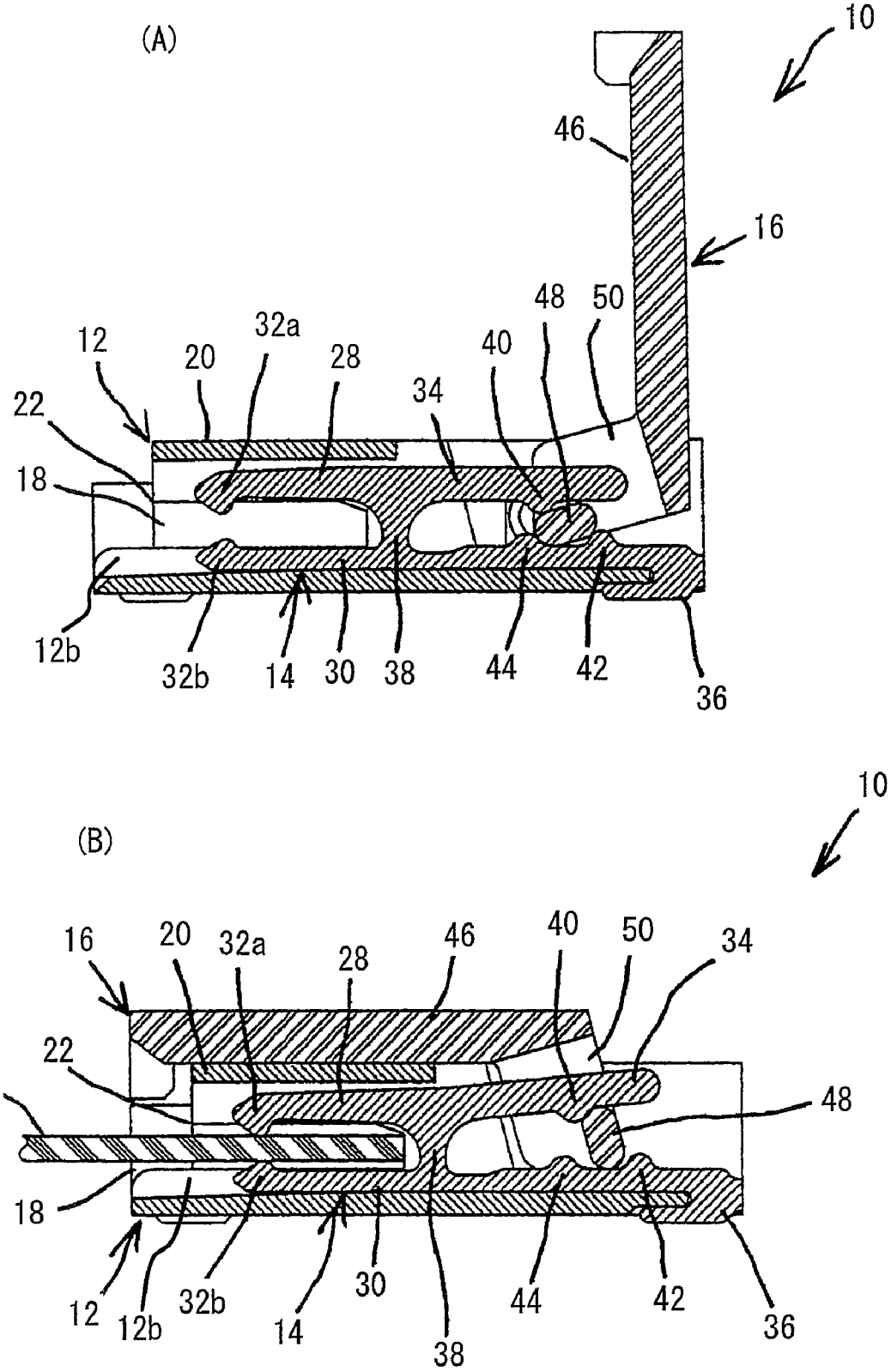
FIG. 2 is a sectional view (A) of the connector according to the invention with the pivoting member opened, taken along a contact, and a sectional view (B) of the connector with a flexible printed circuit board inserted and the pivoting member closed, taken along the contact.

FIG. 1(A) is a perspective view of the connector according to the invention with its pivoting member opened, viewed from its fitting opening side, and FIG. 1(B) is a perspective view of the connector with its pivoting member opened, viewed from the connection portion side. FIG. 2(A) is a sectional view of the connector according to the invention with the pivoting member opened, taken along one contact, while FIG. 2(B) is a sectional view of the connector with a flexible printed circuit board inserted and the pivoting member closed, taken along the contact. FIG. 3(A) is a perspective view illustrating the contacts used in FIGS. 1 and 2. FIG. 4 is a perspective view of the pivoting member. FIG. 5(A) to (F) illustrates explanatory views for explaining movements of pushing portion and axis of rotation when the pivoting member is pivotally moved from its opened position to its closed position.

The connector 10 according to the invention mainly comprises a housing 12, the pivoting member 16 and contacts 14.

The components of the connector 10 according to the invention will be explained with reference to FIGS. 1 to 5.

First, the contacts 14 will be explained. The contacts 14 are made of a metal and formed by means of the press-working of the known technique. Preferred metals from which to form said contacts 14 include brass, beryllium copper, phosphor bronze and the like which comply with the requirements as to springiness, electric conductivity, and the like.

Figure 3:
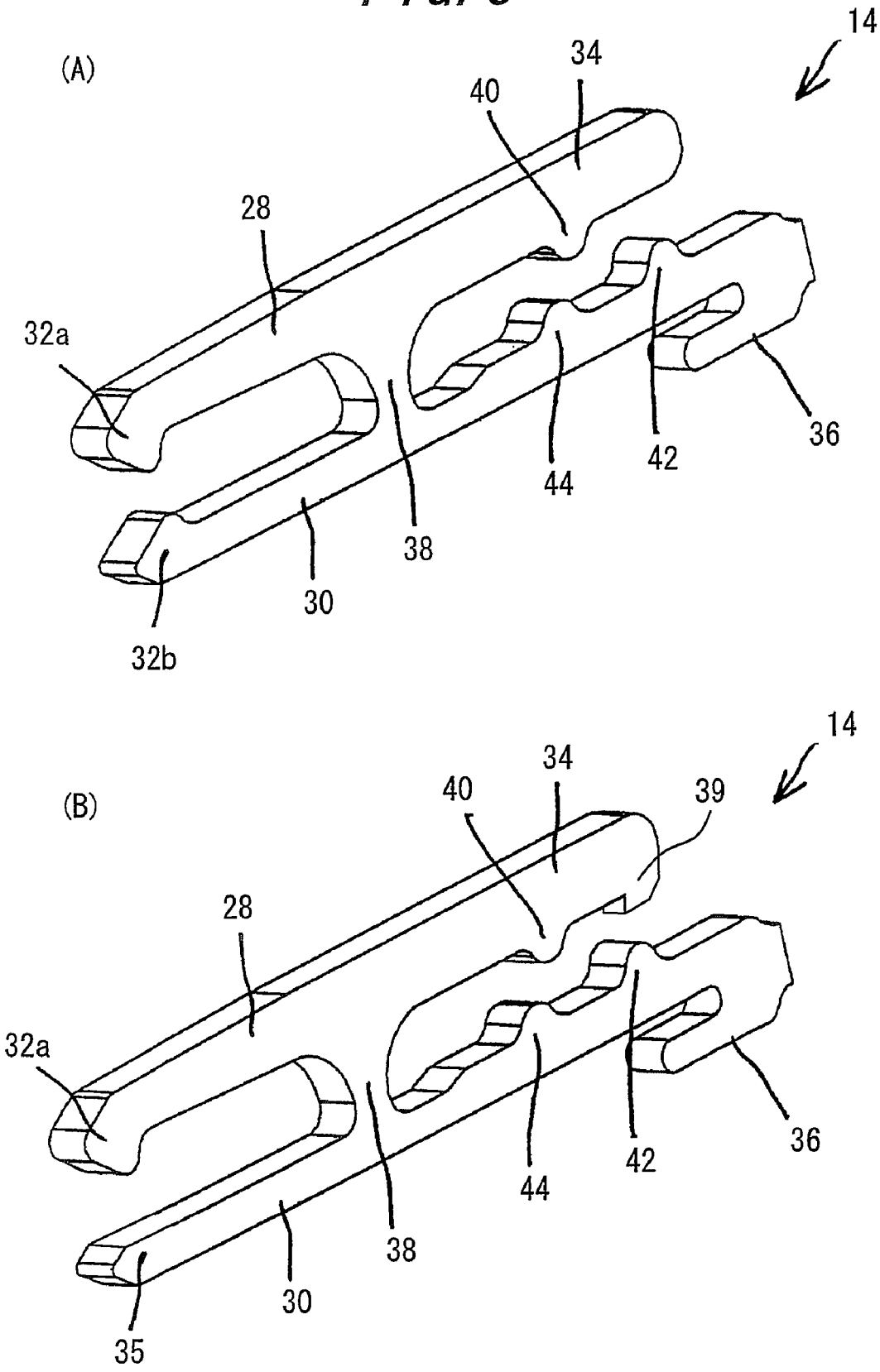
FIG. 3 is a perspective view (A) of one contact and a perspective view (B) of another contact.
Figure 4:
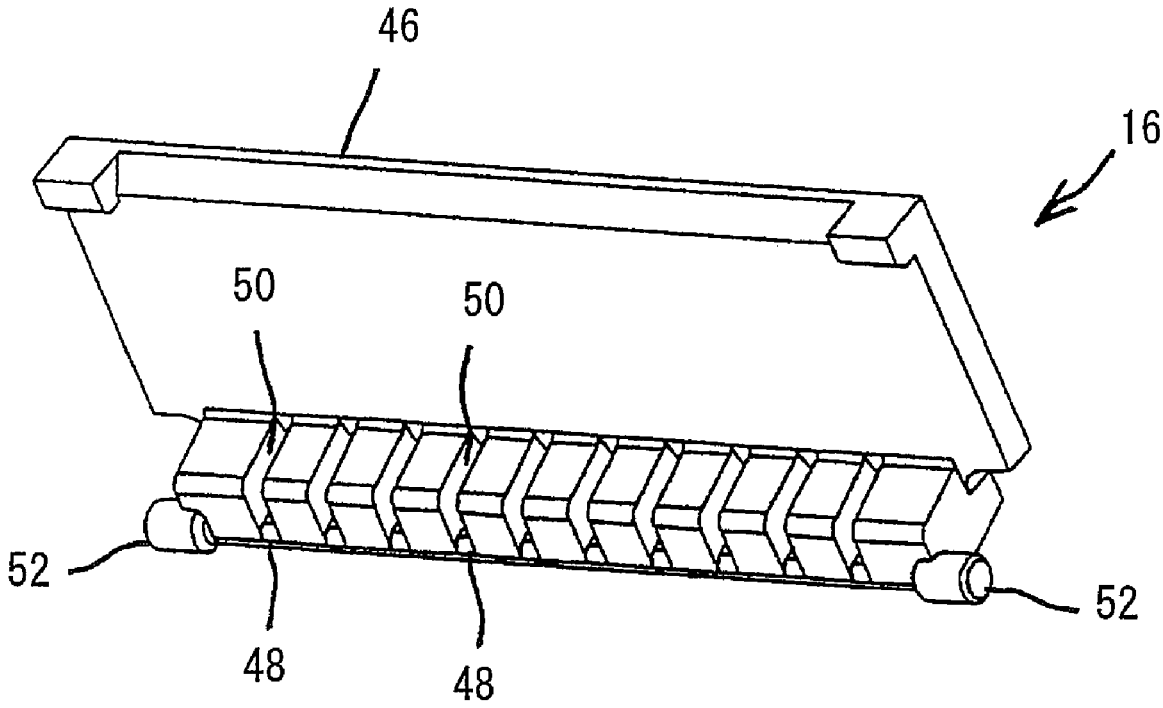
FIG. 4 is a perspective view of the pivoting member.
Figure 5:
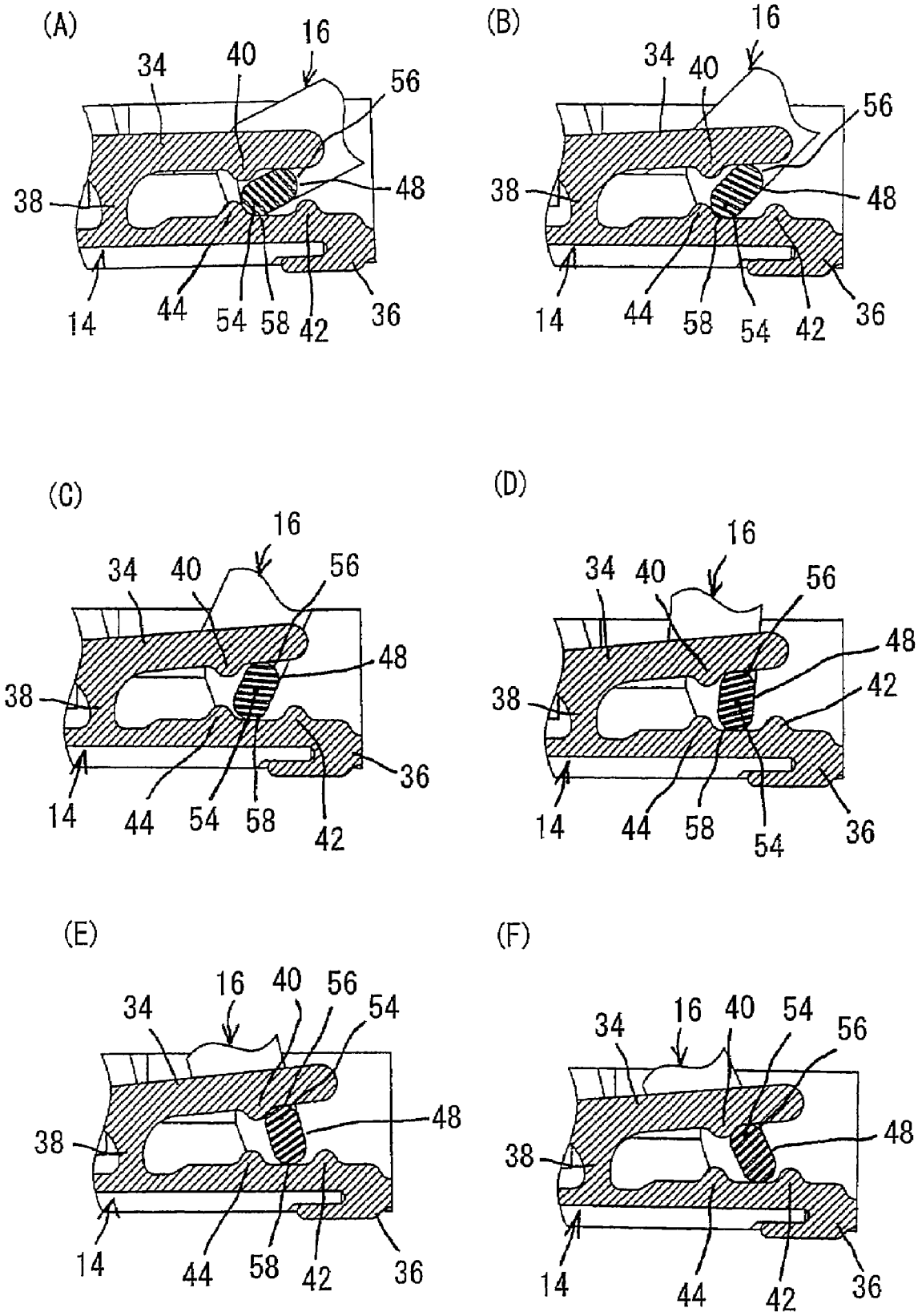
FIG. 5 illustrates explanatory views (A) to (F) for explaining the movements of pushing portions and axis of rotations during the pivotal movement of the pivoting member.
Figure 6:
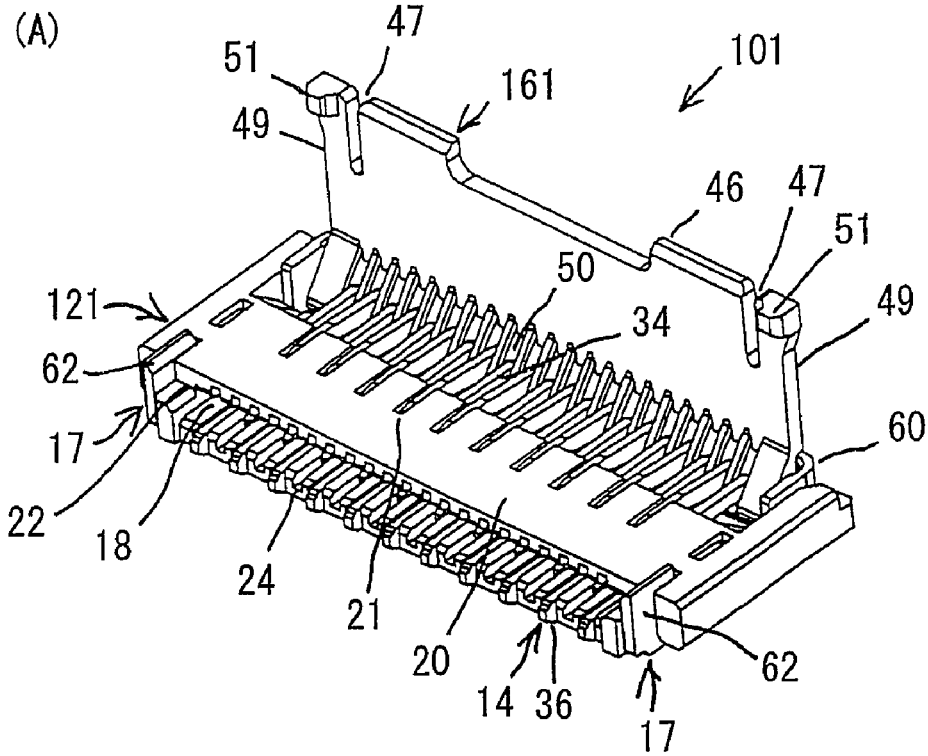
FIG. 6 is a perspective view (A) of another connector according to the invention with its pivoting member opened, viewed from the above on the fitting opening side and a perspective view (B) of the connector with the pivoting member opened, viewed from the above on the opposite side of the fitting opening.
Figure 6:
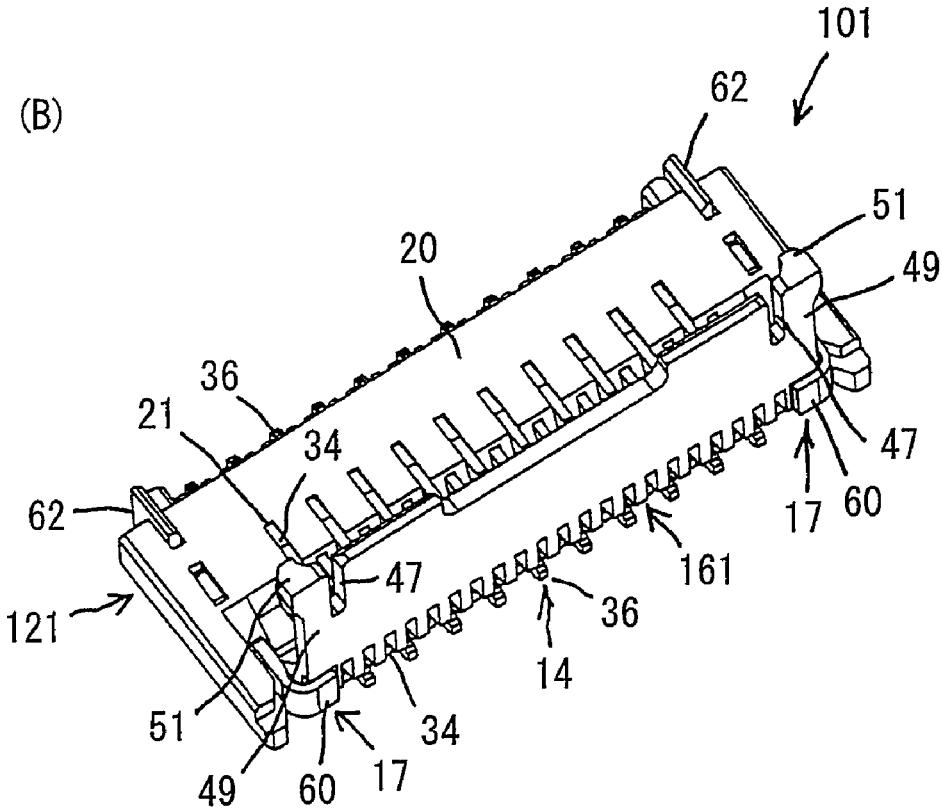
Figure 7:
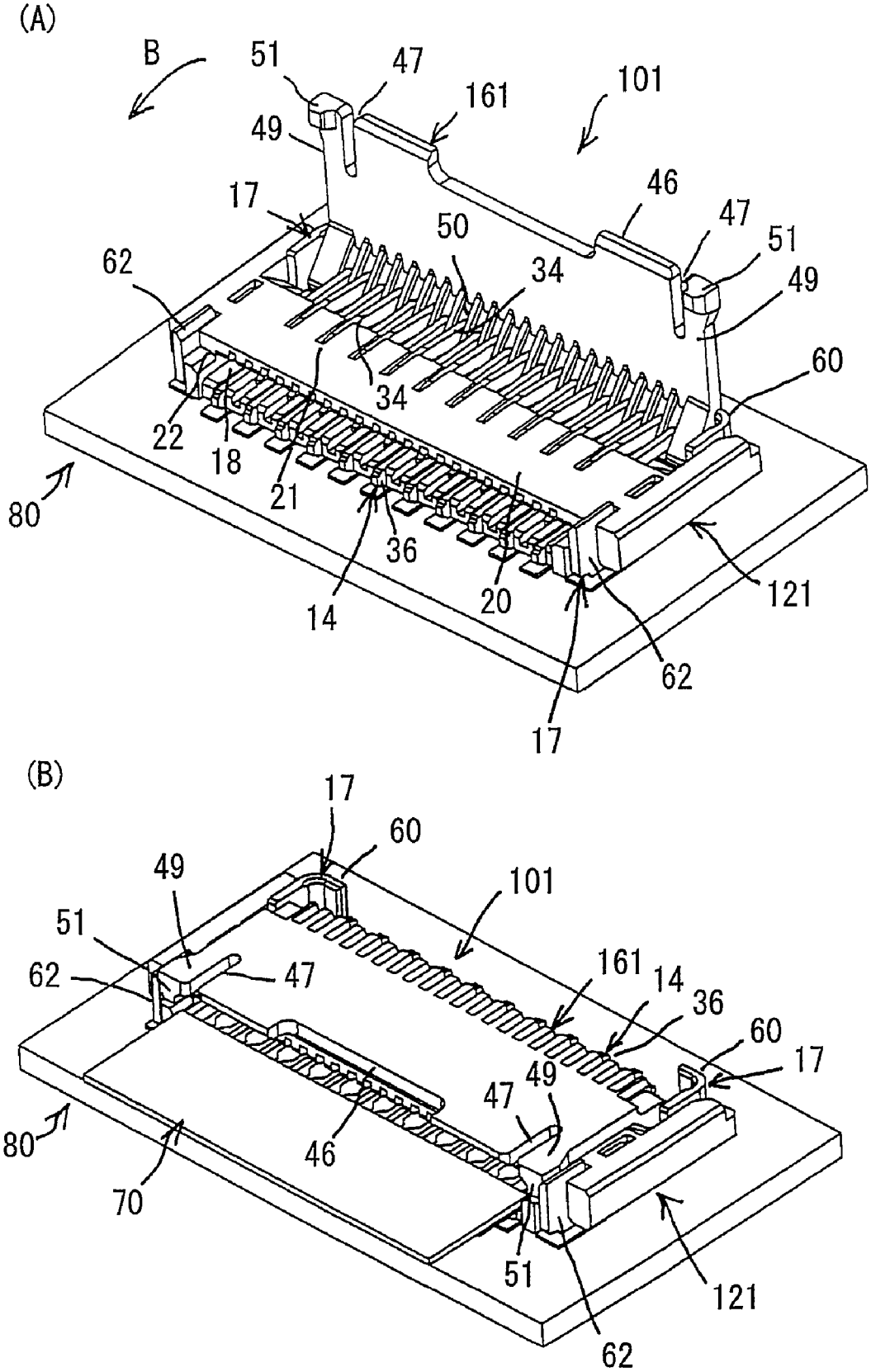
FIG. 7 is a perspective view (A) of the another connector attached to a substrate with the pivoting member opened, viewed from the above on the fitting opening side, and a perspective view (B) of the connector attached to the substrate with the pivoting member closed, viewed from the above on the fitting opening.

In the embodiment, said contacts 14 are of an inverted H-shaped as shown in FIG. 3. The contacts 14 each comprise a first piece 28 having at one end a contact portion 32*a* adapted to contact a connecting object and at the other end a pressure receiving portion 34 adapted to be pushed by said pivoting member 16, a second piece 30 having at one end a further contact portion 32*b* adapted to contact said connecting object and at the other end a connection portion 36 to be connected to a substrate, and a jointing portion 38 for connecting said first piece 28 and said second piece 30. The contact portion 32*a* of said first piece 28, said jointing portion 38, and said connection portion 36 are arranged in the form of a crank, while holding means is provided for enabling a pushing portion 48 of said pivoting member 16 to be pivoted or pivotally moved between said pressure receiving portion 34 and said connection portion 36.

The contact portions 32*a* and 32*b* are of a protruded shape for facilitating the contact with a connecting object such as a flexible printed circuit board or flexible flat cable. In the embodiment, said connection portions 36 are of a surface mounting type (SMT) as shown in FIG. 1, but they may be of a dip type. In the embodiment, one contact 14 is provided with two contact portions 32*a* and 32*b* between which a flexible printed circuit board or flexible flat cable is embraced. In other words, as the contact portions 32*a* and 32*b* are provided on both the sides of the inserting direction of the flexible printed circuit board or flat cable, the circuit board or flat cable is embraced by the contact portions 32*a* and 32*b*, thereby securely bringing the contact portions into contact with the circuit board or flat cable and simultaneously enabling the contacts to tolerate a circuit board having contacts only on its one surface.

The jointing portions 38 and the pressure receiving portions 34 serve to achieve the following function when a connecting object such as a flexible printed circuit board or flexible flat cable is inserted into the connector. After the connecting object such as the flexible printed circuit board or flat cable has been inserted into the fitting opening 18 of the housing 12, when the pushing portions 48 of said pivoting member 16 are pivotally moved between the connection portions 36 and the pressure receiving portions 34 of said contacts 14, said pressure receiving portions 34 are raised by the pushing portions 48 so that the jointing portions 38 of said contacts 14 are tilted toward said contact portions 32*a* about lower ends 58 of the jointing portions 38 of the contacts 14, thereby causing said contact portions 32*a* to be pushed against the connecting object such as the flexible printed circuit board 70 or flat cable. The sizes and shapes of said jointing portions 38 and said pressure receiving portions 34 may be suitably designed for achieving such functions.

As said holding means, a projection 40 is provided on at least every other contact 14 arranged in a row so as to extend from the pressure receiving portion 34 of said first piece 28 toward said connection portion 36 and further a protrusion 42 is provided on the at least every other contact 14 so as to extend from the proximity of the connection portion 36 of said second piece 30 toward said pressure receiving portion 34. The shapes and the sizes of said projections 40 and said protrusions 42 may be suitably designed so as to obtain a stable pivotal movement of the pushing portions 48 without dislodgment of the pushing portions 48 of said pivoting member 16 when the pushing portions 48 are pivotally moving. In the embodiment, the projections 40 and the protrusions 42 are substantially rounded to avoid any damage of the pushing portions 48 of said pivoting member 16.

As said holding means, moreover, a raised portion 44 is provided on at least every other contact 14 so as to extend from the second piece 30 between the connection portion 36 and the jointing portion 38 toward said pressure receiving portion 34. The contacts 44 each having the projection 40 and the protrusion 42 and the contacts 44 each having the raised portion 44 are alternately arranged so that the projections 40, the protrusions 42 and the raised portions 44 are arranged to be alternately staggered. With this arrangement of the contacts 14, the pushing portions 48 of said pivoting member 16 can be more smoothly pivoted. The shape and size of said raised portions 44 may be suitably designed so as to obtain a stable pivotal movement of the pushing portions 48 without dislodgment of the pushing portions 48 of the pivoting member 16 when the pushing portions 48 are pivotally moving. In the embodiment, the raised portions 44 are substantially rounded to avoid any damage of the pushing portions 48 of the pivoting member 16. As shown in FIG. 3(A), moreover, all said projection 40, said protrusion 42, and said raised portion 44 may be provided on the same contact 14.

Moreover, when the pushing portions 48 of said pivoting member 16 are pivoted or pivotally moved between the pressure receiving portions 34 and the connection portions 36 of the contacts 14, the center of the pivoting member 16 is often deformed in the direction shown by an arrow A in FIG. 1(A) due to strong reaction forces against the pivotal movement of the pivoting member 16. By providing an extended portion 39 at the tip end of the pressure receiving portion 34 of said first piece 28 of each of the contacts, the deformation of the center of the pivoting member 16 can be effectively prevented. The size of said extended portions 39 may be any one insofar as they can achieve the function described above, and may be suitably designed to an extent such that the pushing portions 48 of the pivoting member 16 can engage the extended portions 39.

The pivoting member 16 will then be explained. The pivoting member 16 is formed from an electrically insulating plastic material by means of the injection molding of the known technique. The materials for the pivoting member 16 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC) and the like and combination thereof. The pivoting member 16 has a substantially L-shaped cross-section and mainly comprises an actuating portion 46, axles 52 adapted to be fitted in the housing 12 in a pivotally movable and displaceable manner (fitted in the housing with clearances which permit the displacements of the pushing portions as described with reference to FIG. 5), the pushing portions 48 for pushing the pressure receiving portions 34 of said contacts 14, and anchoring holes 50 adapted to receive the pressure receiving portions 34 of said contacts 14, respectively. The axles 52 are a fulcrum for pivotally moving the pivoting member 16 and suitably fitted in the housing 12 at its longitudinal ends so as to enable the pivoting member 16 to pivotally move.

The pushing portions 48 are for pushing the pressure receiving portions 34 of the contacts 14. The pushing portions 48 are preferably of an elongated shape, and elliptical in the embodiment. With such an elliptical shape, when the pivoting member is pivotally moved in the direction shown by an arrow B as shown in FIG. 1(A) so as to pivotally move its pushing portions 48 between the pressure receiving portions 34 and the connection portions 36 of the contacts 14, the pressure receiving portions 34 of the contacts 14 are moved upwardly with the aid of the variation in contact height of the pushing portions 48 owing to, for example, difference in major and minor axes of an ellipse so that the contact portions 32*a* of the contacts 14 are forced against the connecting object such as the flexible printed circuit board 70 or flexible flat cable. The shape of the pushing portions 48 may be of any one so long as the pushing portions 48 can be pivotally moved between the pressure receiving portions 34 and the connection portions 36 of the contacts 14, and the pressure receiving portions 34 of the contacts 14 can be raised with the aid of the variation in contact height such as a difference in major and minor axes of the ellipse.

In order to prevent the center of the pivoting member 16 from being deformed in the direction shown by the arrow A in FIG. 1(A) owing to the strong reaction forces against the pivotal movement of the pivoting member 16 when it is pivotally moving, the pivoting member 16 is preferably provided with the anchoring holes 50 independently from one another which are adapted to be engaged by the extended portions 39 of said contacts 14. The anchoring holes 58 provided independently from one another will contribute to enhancing the strength of the pivoting member 16 and prevent the deformation of the pivoting member when it is pivotally moving.

Finally, the housing 12 will then be explained. The housing 12 is formed from an electrically insulating plastic material by means of the injection molding of the known technique. The materials for the housing 12 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC) and the like and combination thereof.

Said housing 12 is formed with inserting holes 24 in which a required number of contacts 14 are installed by press-fitting, hooking (lancing), welding or the like. The housing 12 is further provided at the longitudinal ends with bearings 26 for supporting the axles 52 of the pivoting member 16 to permit pivotal movement of the axles 52 in the bearings 26 with the aid of the clearances. The shape and size of the bearing 26 may be any ones so long as the axles 52 of the pivoting member 16 can be pivotally moved in the bearings 26 and may be suitably designed in consideration of their functions and the strength and size of the housing 12. The housing 12 is further provided at the longitudinal ends with anchoring portions 12*a* at locations corresponding to locking portions 16*a* of the pivoting member 16.

As shown in FIG. 1(A), said housing 12 has said fitting opening 18 at its front portion and a ceiling portion 20 covering or insulating the contact portions 32 of the first pieces 28 of said contacts 14. The ceiling portion 20 is formed with protection walls 22 at least at both the ends for preventing the ceiling portion 20 from deforming upwardly when a connecting object is accidentally forced upwardly. The term "protection wall" means an edge-shaped wall without being chamfered or inclined at the front end of the fitting opening 18. By providing the protection walls 22, however, function and effect for guiding the connecting object such as the flexible printed circuit board 70 and the like may become impossible.

As a method for guiding the connecting object such as the flexible printed circuit board 70 into the fitting opening 30, the connecting object is put or applied onto the lower face 12*b* of the housing 12 at the fitting opening 18 and is then inserted into the fitting opening 18 shown in FIG. 1(A), thereby easily guiding it into the fitting opening 18.

In order to ascertain the effects of the protection walls, under a condition of the connector with a flexible printed circuit board 70 inserted and with the pivoting member 16 closed, the flexible printed circuit board 70 was pulled in a direction perpendicular to the connector in a tension tester (this condition is the same as that the printed circuit board is accidentally forced upwardly when the connector is used in its horizontal position). The results are shown in Table 1 and Table 2 (Graph 1). The "holding force" in Table 1 and Graph 1 means the force at a moment when the contacts 14 are disconnected from the flexible printed circuit board 70 while the circuit board 70 is being pulled.

In the Table 1 and Graph 1, the prior art connector is the connector having the fitting opening 18 of which ceiling portion 20 is chamfered all over it without any protection wall 22. The improved connectors 1 (only at both ends) are connectors having the fitting opening whose ceiling portion 20 is provided with protection walls 22 only at both the ends of the fitting opening 18 (both the ends are not chamfered). The improved connectors 2 (all over ceiling) are connectors having the fitting opening whose ceiling portion 20 is provided with a protection wall 22 all over it.

TABLE 1

| | | Number of conductors | | | | | | | |
|---|---|---|---|---|---|---|---|---|---|
| | | 18 | | | | 27 | | | |
| | | Sample No. | | | | | | | |
| | | 1 | 2 | 3 | 4 | 1 | 2 | 3 | 4 |
| Prior art | | 3.6 N | 3.6 N | 4.1 N | 4.0 N | 4.2 N | 4.8 N | 4.6 N | 4.5 N |
| Improved connector with protection wall (First invention) | Improved connector 2 (all over ceiling) | 9.1 N | 9.1 N | 8.8 N | 8.9 N | 9.1 N | 9.0 N | 9.0 N | 8.9 N |
| | Improved Connector 1 (only at both ends) | 8.6 N | 8.2 N | 8.4 N | 8.5 N | 9.2 N | 8.8 N | 8.6 N | 9.1 N |
| Mean value of prior art | | 3.83 N | | | | 4.53 N | | | |
| Mean value of improved connector (First invention) | Improved connector 2 (all over ceiling) | 8.98 N | | | | 9.00 N | | | |
| | Improved connector 1 (only at both ends) | 8.43 N | | | | 8.93 N | | | |

TABLE 2

(Graph 1)

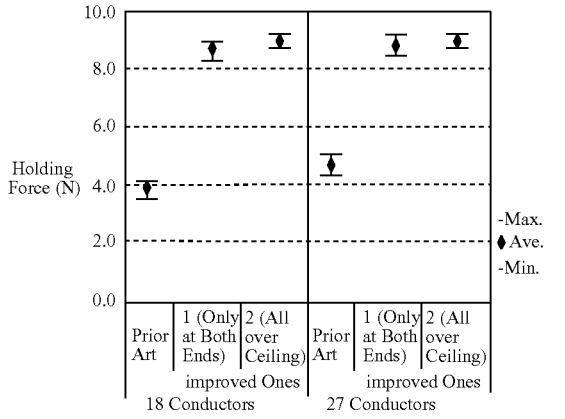

Referring to Table 1 and Graph 1 (Table 2), with respect to the means values, in the case of 18 conductors the holding forces (forces at disconnection of the contacts) increase to 8.43 N for the improved connectors 1 (provided with the protection walls only at both ends) and the holding forces increase to 8.98 N for the improved connectors 2 (provided with the protection wall all over the ceiling portion). In the case of 27 conductors, the holding forces increase to 8.93 N for the improved connectors 1 and the holding forces increase to 9.00 N for the improved connectors 2. Namely, the holding forces of the improved connectors 1 and 2 are about two times those of the prior art connectors. It is clear from these results that the protection walls 22 provided only at the both ends or all over the ceiling portion contribute to increase in the holding forces (forces at the disconnection of the contacts). In other words, by providing the protection walls 22 only on both the sides of the fitting opening 18 or all over it, the holding forces signifying the stability of contact between the contacts and the connecting object will increase to twice when being accidentally subjected to external forces. This means that the stability against the accidental external forces has increased. It is also apparent that there is no large difference in holding forces between the protection walls 22 provided only at both the ends and the protection wall all over the ceiling portion of the fitting opening. The improved percentages of holding forces are 220.1% with 18 conductors and 197.1% with 27 conductors. The improved percentage is the value obtained by dividing a holding force (mean value) for improved connectors by a holding force (mean value) for prior art connectors. The number of locations provided with the protection walls 22 is preferably as few as possible in consideration of the fact that there is no large difference in holding forces between the protection walls 22 provided only at both the ends and provided all over the ceiling portion of the fitting opening, and the prevention of the object such as the flexible printed circuit board from being scratched (damaged). As to located positions of the protection walls, although they are provided only at both the ends in the illustrated embodiment, it is preferable to form the protection walls at three locations, that is, at both the ends and at the center, from the standpoint of balancing. In order to prevent the connecting object such as the flexible printed circuit board or the like from being scratched (damaged), it is preferable to design the housing in a manner that it does not contact the connecting object when the connecting object is accidentally subjected to an external force. For this purpose, it is considered to provide a chamfered portion, round chamfer, recessed chamfer or stepped recess. The chamfered portion is preferable in consideration of esthetical quality, material cost and the like of the connector 10.

As to the conducting the connecting object into the fitting opening 18, by employing the methods described above or below, it is sufficiently possible to conduct it without chamfering the ceiling portion 20 of the fitting opening 18.

The movement and pivotal movement of the pushing portions 48 of said pivoting member 16 will then be explained with reference to FIG. 5(A) to (F).

FIG. 5(A) illustrates a state that the lower end 58 of the pushing portion 48 of said pivoting member 16 is in contact with the raised portion 44 before the connecting object is connected to the connector 10.

When the actuating portion 46 of the pivoting member 16 is pivotally moved (in the counterclockwise direction viewed in the drawing) as shown in FIG. 5(B), the pushing portion 48 is pivotally moved about the center (axis 54 of rotation) of the curvature of the lower end 58 which is in contact with said raised portion 44, whereby the pushing portion 48 assumes a slightly inclined position.

The actuating portion 46 of the pivoting member 16 is further pivotally moved as shown in FIG. 5(C), the lower end 58 somewhat moves from the position shown in FIG. 5(B) toward said connection portion 36 so that the pushing portion 48 is pivotally moved about the center (axis 54 of rotation in this stage) of the pushing portion 48, whereby the pushing portion 48 assumes a substantially vertical position.

The actuating portion 46 of the pivoting member 16 is further pivotally moved as shown in FIG. 5(D), the lower end 58 further moves from the position shown in FIG. 5(C) toward the connection portion 36 and the upper end 56 of the pushing portion 48 moves toward said projection 40, whereby the pushing portion 48 assumes a vertical position.

As shown in FIG. 5(E), the lower end 58 further moves from the position shown in FIG. 5(D) toward said connection portion 36 and the upper end 56 of said pushing portion 48 comes into contact with said projection 40.

As shown in FIG. 5(F), the pushing portion 48 is further pivotally moved from the position shown in FIG. 5(E), the pushing portion 48 is pivotally moved about the center (axis 54 of rotation in this stage) of the curvature of the upper end 56 toward the fitting opening 18 of said housing 12, thereby bringing the contact portions 32 of said contacts 14 into contact with said connecting object.

In other words, said pushing portion 48 is initially pivotally moved and then moved or displaced, and further pivotally moved, during which the axis 54 of rotation moves so that the pushing portion performs its compact and space-saving pivotal movement (rotation).

Namely, the connector 10 according to the invention has a structure which does not need an inserting force when a connecting object such as a flexible printed circuit board 70 is inserted into the fitting opening 18 (so called "zero-insertion force (ZIF) structure), which enables said pivoting member 16 to be locked by means of a slight force by causing the pushing portions 48 of said pivoting member 16 to be pivotally moved between the projections 40, the protrusion 42 and the raised portions 44 of said contacts 14, and which can obtain high contact forces between the contacts and the connecting object by raising the pressure receiving portions 34 of said contacts 14 by the pushing portions 48 of said pivoting member 16.

One embodiment of another connector according to the invention will be explained with reference to FIGS. 6 to 9 and FIG. 11.

Figure 8:
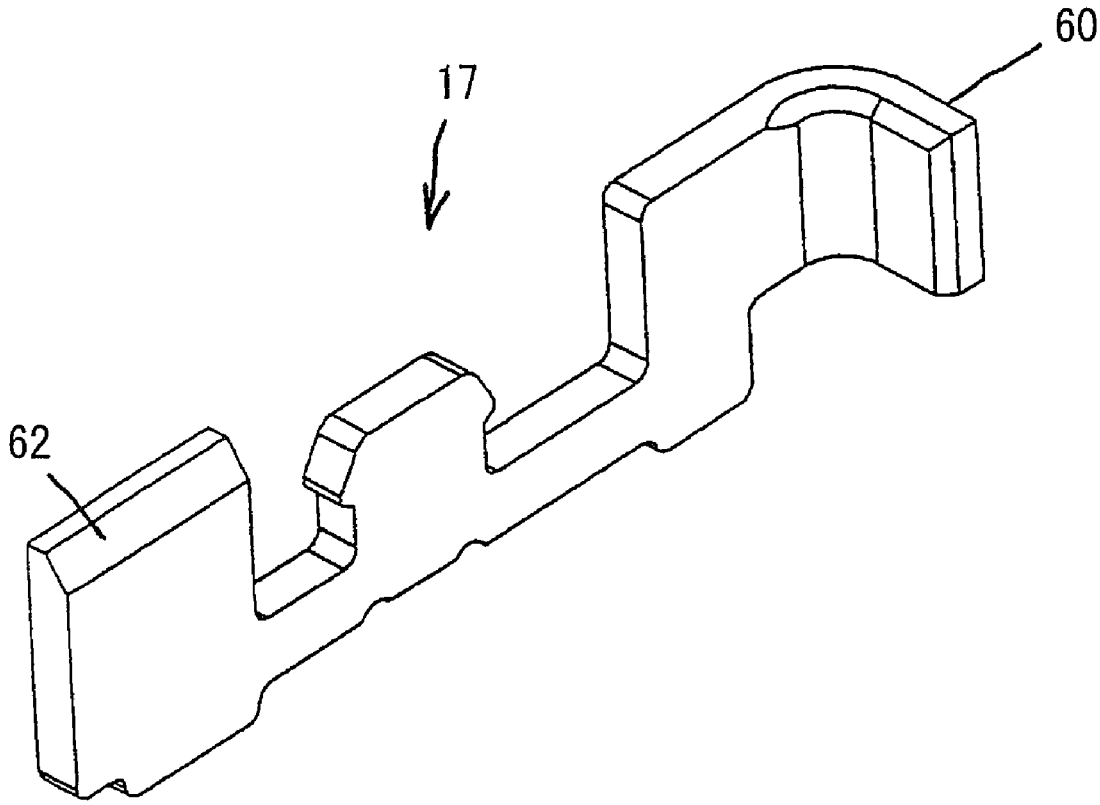
FIG. 8 is a perspective view of a fixture.
Figure 9:
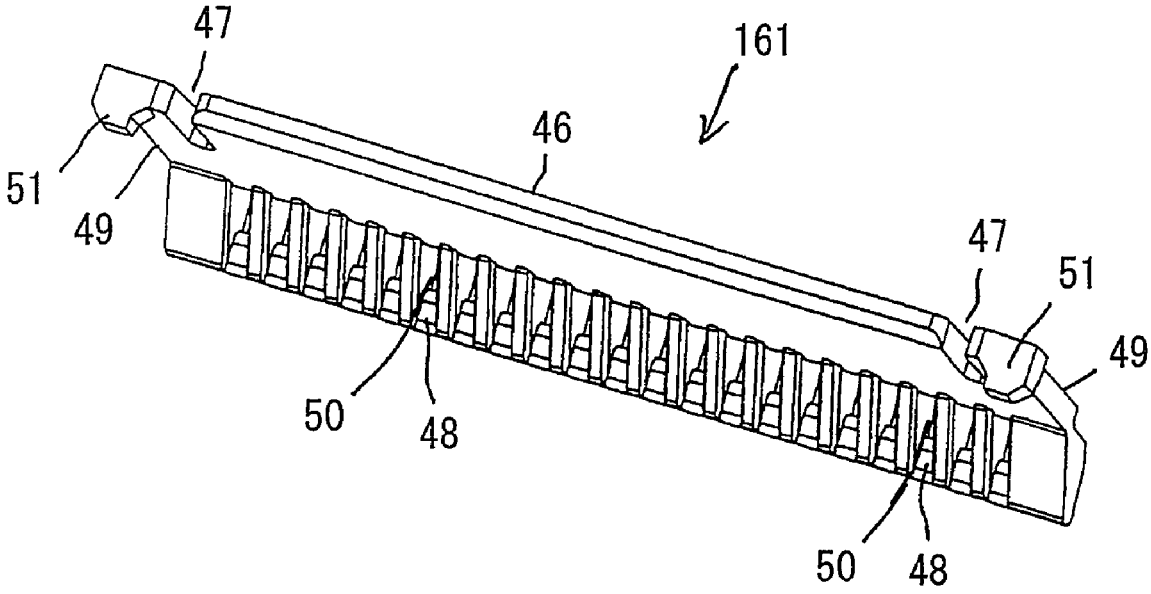
FIG. 9 is a perspective view of another pivoting member.

FIG. 6(A) is a perspective view of another connector according to the invention with a pivoting member opened, viewed from its fitting opening side, and FIG. 6(B) is a perspective view of the connector with the pivoting member opened, viewed from the above on the opposite side of the fitting opening. FIG. 7(A) is a perspective view of the connector attached to a substrate with the pivoting member opened, viewed from the above on the fitting opening side, while FIG. 7(B) is a perspective view of the connector attached to the substrate with the pivoting member closed, viewed from the above of the fitting opening side. FIG. 8 is a perspective view of a fixture, and FIG. 9 is a perspective view of another pivoting member.

The another connector 101 according to the invention mainly comprises a housing 121, a pivoting member 161, contacts 14, and a fixture 17.

Respective components of the connector 101 will be explained. Differences from the connector 10 described above only will be explained hereinafter.

The contacts 14 of the connector 101 will not be described in further detail since they are substantially the same as those of the connector 10. As the movement and pivotal movement of pushing portions of the pivoting member 161 are also similar to those described with reference to FIG. 5, such movements will not be described.

The pivoting member 161 will then be explained. Said pivoting member 161 is provided with plate-shaped pieces 49 having elasticity which are formed by slits 47 serving to define the pieces 49. Said plate-shaped pieces 49 each have a raised portion 51 which engages the inside of an extended portion 62 of the fixture 17 substantially perpendicular to the ceiling portion 20 of the housing 121 for securely holding the pivoting member 161. Said slit 47 serves to provide the elasticity to the plate-shaped piece 49 to embrace the extended portion 62 of the fixture 17 between the plate-shaped piece 49 and the housing 121. The positions of said plate-shaped pieces 49 and the raised portions 51 at their tips are designed so as to enable the engagement with the extended portions 62 of the fixture 17 and embracing the extended portions 62. The sizes of said plate-shaped pieces 49 and the raised portions 51 at their tips are suitably designed in consideration of the above functions, the elasticity, strength, and the like.

Said housing 121 will then be explained. A ceiling portion 20 of said housing 121 is formed with a plurality of slits 21 only at locations corresponding to the contacts 14 to be inserted into the housing from the side opposite to the inserting opening 18. The slits 21 provide spaces in which first pieces of the contacts 14 are embedded. The sizes of the slits are somewhat larger than the contacts 14 and may be suitably designed in consideration the size of the contacts 14, and the strength and functions of said housing 12. The slits 21 are formed to receive said contact 14 to contribute to a reduced overall height of the connector.

Finally, the fixtures 17 will be explained. The fixture 17 is made of a metal and formed by means of the press-working of the known technique. Preferred metals from which to form said fixture 17 include brass, beryllium copper, phosphor bronze and the like which comply with the requirements as to springiness, connectivity, dimensional stability, and the like.

Said the fixtures 17 are substantially plate-shaped pieces which are fixed to both the longitudinal ends of said housing 121 by press-fitting, integral molding (molding the housing together with the fixtures previously arranged in a mold for molding the housing), welding or the like. The positions of the fixtures 17 are designed in consideration of specifications of customers, mounting position onto a substrate, and the like. The size of said fixtures 17 may be designed in consideration of the holding force of the fixtures, occupied area of the substrate, and the like.

Said fixture 17 is provided with the extended portion 62 as an integral part or separate part which has an elasticity and is perpendicular to the ceiling portion 20 of the housing 121 when the fixture 17 is fixed to the housing. It is preferable to form said extended portion 62 integrally with the fixture 17 from the standpoint of the manufacturing cost. Said extended portion 62 is provided such that the raised portion 51 engages the inside of the extended portion 62. In other words, by providing the fixtures 17 at both the longitudinal ends of the housing, the extended portions 62 of the fixtures 17 are also arranged at both the longitudinal end so that the raised portions 51 located at both the longitudinal ends of the pivoting member 16 engage the extended portions 62 of the fixtures 17, thereby securely holding said pivoting member 161. The positions and size of said extended portions 62 may be suitably designed in consideration of such functions, workability, strength and the like. Moreover, said extended portions 62 have elasticity for facilitating the insertion of the raised portions 51 of said pivoting member 161 and securely holding the pivoting member 161.

Moreover, the fixture 17 is provided with an extended piece 60 adapted to come into contact with the upper surface of said pivoting member 161 when the pivoting member is opened. The extended pieces 60 of the fixtures 17 serve to limit the rotating angle of said pivoting member 161 upon being opened. The positions, the size and the shape of the extended pieces 60 may be suitably designed in consideration of such functions, strength and the like. Said extended piece 60 may be formed integrally with or separately from said fixture 17, but is preferable to form integrally with the fixture 17 from the standpoint of working cost.

Figure 10:
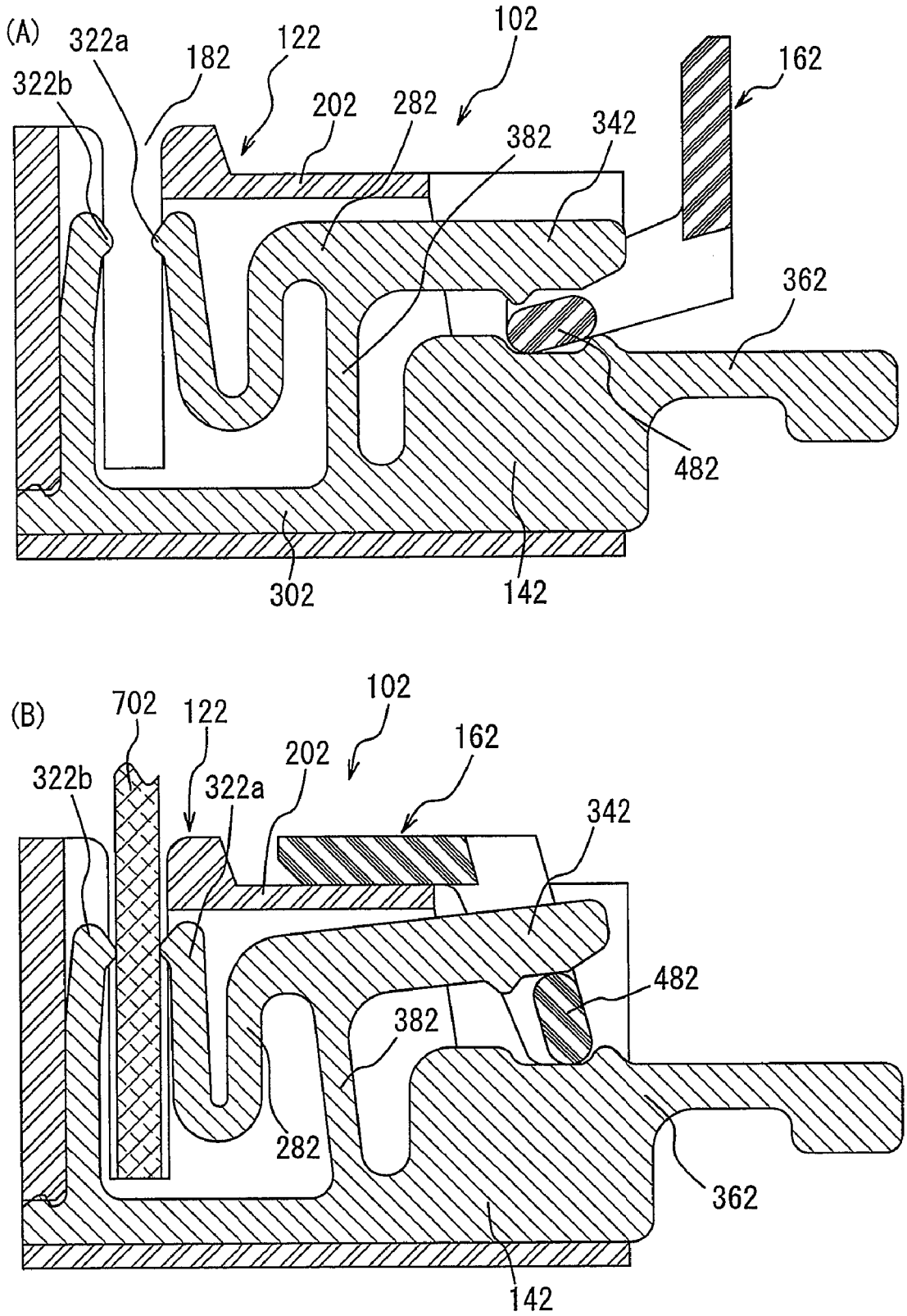
FIG. 10 is a sectional view (A) of a further connector according to the invention with its pivoting member opened, taken along a contact, and a sectional view (B) of the connector with a flexible printed circuit board inserted and with the pivoting member closed, taken along the contact.
Figure 11:
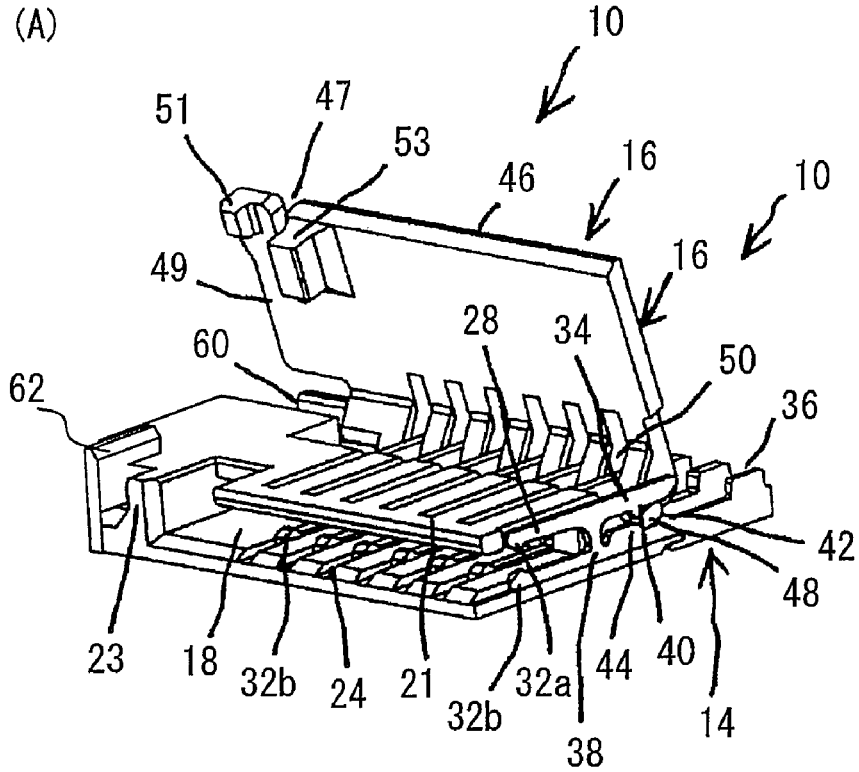
FIG. 11 is a perspective view (A) of a connector according to the invention with a pivoting member opened, viewed from its fitting opening side, and a perspective view (B) of the connector with a flexible printed circuit board inserted and with the pivoting member closed, viewed from the fitting opening side.
Figure 11:
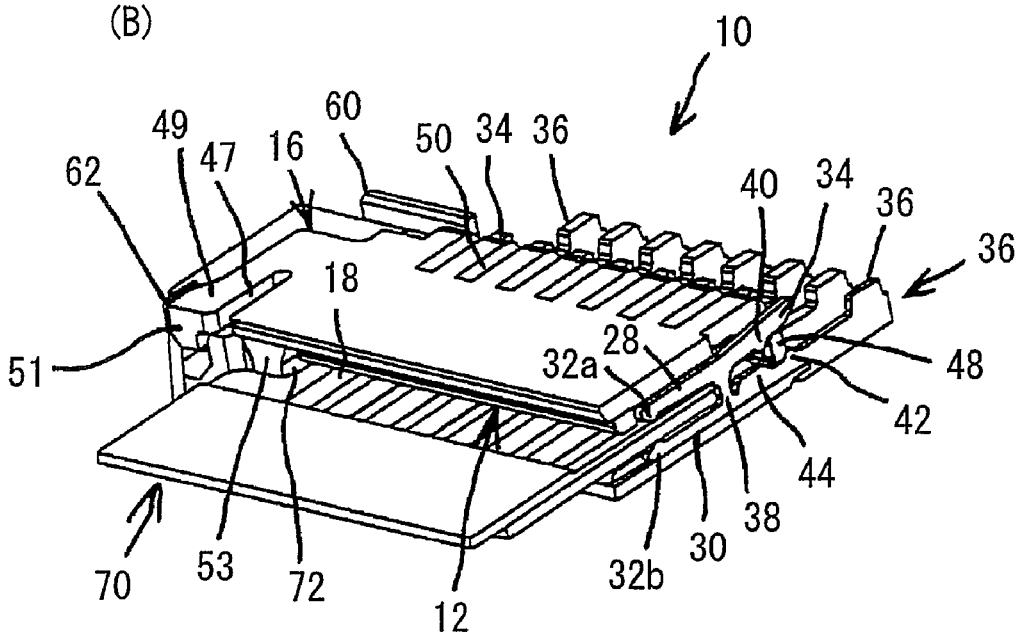

One embodiment of a further connector 102 according to the invention will then be explained with reference to FIGS. 10(A) and (B). FIG. 10(A) is a sectional view of the connector 102 with its pivoting member opened, taken along one contact, and FIG. 10 (B) is a sectional view of the connector with a flexible printed circuit board inserted and with the pivoting member closed, taken along the one contact.

The connector 102 of the present embodiment according to the invention mainly comprises a housing 122, a pivoting member 162, and contacts 142.

Although respective components will be explained, only differences from those of the connector 10 described above will be explained hereafter.

First, contacts 142 will be explained. Said contacts 142 in the embodiment have a shape as shown in FIG. 10, and each comprise a first piece 282 having at one end a contact portion 322*a* adapted to contact a connecting object and at the other end a pressure receiving portion 342 adapted to be pushed by the pivoting member 162, a second piece 302 having at one end a further contact portion 322*b* adapted to contact the connecting object and at the other end a connection portion 362 to be connected to a substrate, and a jointing portion 382 for connecting said first and second pieces 282 and 302, and further comprise between said pressure receiving portion 342 and said connection portion 362 holding means permitting the pivotal movement of pushing portions 482 of the pivoting member 162.

Other construction of the contact 142 will not be described since the other construction is similar to that of said contact 14. Moreover, as to the construction of said pivoting member described by referring to FIG. 4 and the movement and the pivotal movement of the pushing portions of said pivoting member described by referring to FIG. 5 the same holds true, and therefore these of the pivoting member 162 will not be described.

Finally, the housing 122 will be explained. Said housing 122 comprises a fitting opening 182 at the upper portion, and a ceiling portion 202 covering or insulating said contact portions 322*a* of the first pieces 282 of said contacts 142.

In another embodiment of the pivoting member, in the proximities of both longitudinal ends of a pivoting member 16 at locations corresponding to anchoring portions 72 of a connecting object such as a flexible printed circuit board or flat cable, there are provided engaging projections 53 adapted to engage said anchoring portions 72. When said pivoting member 16 is closed, said engaging projections 53 engage said anchoring portions 72 so that said connecting object 70 is positioned and held. The positions of said engaging projections 53 may be suitably designed so as to correspond to the positions of the anchoring portions 72 of the connecting object 70 to be inserted into the anchoring portions 72. The size of said engaging projections 53 need only be able to engage the anchoring portions 72 of the connecting object, and may be suitably designed in consideration of the miniaturization of the connector 10, high density of connecting object, and the like. For example, it is envisioned that the engaging projections 53 are provided on the inner side of the slits 47 at both the longitudinal ends.

In another embodiment of the contacts, instead of the contact portion 32*b* of the second piece as shown in FIG. 3(A), the second piece may be provided at one end with an extension portion 35 adapted to contact a connecting object as shown in FIG. 3(B).

INDUSTRIAL APPLICABILITY

Example of applications of the invention are connectors for use in electric and electronic appliances such as mobile appliances and the like, which are particularly superior in stable electrical connection with a connecting object such as a flexible printed circuit board or flexible flat cable and achieve minimization of area occupied by a substrate.

The invention claimed is:

1. A connector including:

a plurality of contacts each having two contact portions adapted to contact a connecting object, a housing arranging and holding said contacts therein and having at its front portion a fitting opening into which said connecting object is inserted, and a pivoting member causing said contacts to be elastically deformed to push the contacts against said connecting object, wherein each of said contacts comprises a first piece having on one side of one end one of the two contact portions adapted to contact said connecting object and on one side of another end a pressure receiving portion adapted to be pushed by said pivoting member, a second piece having on one side of one end the remaining contact portion adapted to contact said connecting object and on one side of another end a connection portion adapted to be connected to a substrate, and a jointing portion for connecting said first and second pieces, and the contact portion of said first piece, said jointing portion, and said connection portion being arranged in the form of a crank, and wherein said contacts further comprise holding means permitting pushing portions of said pivoting member to pivotally move between said pressure receiving portions and said connection portions, wherein said pushing portions have oval shape, wherein said holding means comprises a projection provided on said pressure receiving portion of said first piece of at least every other contact to extend toward said connection portion, and a protrusion provided in the proximity of tip of the connection portion of said second piece of the at least every other contact to extend toward said pressure receiving portion, wherein said housing comprises a ceiling portion for covering the contact portions of said contacts and said pressure receiving portions, and said ceiling portion is provided with protection walls at least at both ends of said ceiling portion for preventing said ceiling portion from being raised when said connecting object is accidentally forced upwardly, and wherein said pivoting member comprises an actuating portion for pivotally moving the pivoting member, the pushing portions continuously arranged in the longitudinal direction of said pivoting member, and anchoring holes independent from one another for receiving therein said pressure receiving portions, respectively, said pivoting member being mounted on said housing so that said pushing portions are pivotally moved between said connection portions and said pressure receiving portions of said contacts, during which pivotal movement the axis of rotation of said pushing portions is moved with their pivotal movement to achieve their compact rotation, and said actuating portion of the pivoting member is pivotally moved toward the fitting opening of said housing to bring the contact portions of said contacts into contact with said connecting object.

2. A connector including:

a plurality of contacts each having two contact portions adapted to contact a connecting object, a housing arranging and holding said contacts therein and having at its upper portion a fitting opening into which said connecting object is inserted, and a pivoting member causing said contacts to be elastically deformed to push the contacts against said connecting object, wherein each of said contacts comprises a first piece having on one side of one end one of the two contact portions adapted to contact said connecting object and on one side of another end a pressure receiving portion adapted to be pushed by said pivoting member, a second piece having on one side of one end the remaining contact portion adapted to contact said connecting object and on one side of another end a connection portion adapted to be connected to a substrate, and a jointing portion for connecting said first and second pieces, and wherein said contacts further comprise holding means permitting pushing portions of said pivoting member to pivotally move between said pressure receiving portions and said connection portions, wherein said pushing portions have oval shape, wherein said holding means comprises a projection provided on said pressure receiving portion of said first piece of at least every other contact to extend toward said connection portion, and a protrusion provided in the proximity of tip of the connection portion of said second piece of the at least every other contact to extend toward said pressure receiving portion, wherein said housing comprises a ceiling portion for covering the contact portions of said contacts and said pressure receiving portions, and wherein said pivoting member comprises an actuating portion for pivotally moving the pivoting member, the pushing portions continuously arranged in the longitudinal direction of said pivoting member, and anchoring holes independent from one another for receiving therein said pressure receiving portions, respectively, said pivoting member being mounted on said housing so that said pushing portions are pivotally moved between said connection portions and said pressure receiving portions of said contacts, during which pivotal movement the axis of rotation of said pushing portions is moved with their pivotal movement to achieve their compact rotation, and said actuating portion of the pivoting member is pivotally moved toward the fitting opening of said housing to bring the contact portions of said contacts into contact with said connecting object.

3. A connector including:

a plurality of contacts each having one contact portion adapted to contact a connecting object, a housing arranging and holding said contacts therein and having at its front portion a fitting opening into which said connecting object is inserted, and a pivoting member causing said contacts to be elastically deformed to push the contacts against said connecting object, wherein each of said contacts comprises a first piece having on one side of one end the one contact portion adapted to contact said connecting object and on one side of another end a pressure receiving portion adapted to be pushed by said pivoting member, a second piece having on one side of one end an extension portion extending in the direction against the inserting direction of said connecting object and on one side of another end a connection portion adapted to be connected to a substrate, and a jointing portion for connecting said first and second pieces, and the contact portion of said first piece, said jointing portion, and said connection portion being arranged in the form of a crank, and wherein said contacts further comprise holding means permitting pushing portions of said pivoting member to pivotally move between said pressure receiving portions and said connection portions, wherein said pushing portions have oval shape, wherein said holding means comprises a projection provided on said pressure receiving portion of said first piece of at least every other contact to extend toward said connection portion, and a protrusion provided in the proximity of tip of the connection portion of said second piece of the at least every other contact to extend toward said pressure receiving portion, wherein said housing comprises a ceiling portion for covering the contact portions of said contacts and said pressure receiving portions, and wherein said pivoting member comprises an actuating portion for pivotally moving the pivoting member, the pushing portions continuously arranged in the longitudinal direction of said pivoting member, and anchoring holes independent from one another for receiving therein said pressure receiving portions, respectively, said pivoting member being mounted on said housing so that said pushing portions are pivotally moved between said connection portions and said pressure receiving portions of said contacts, during which pivotal movement the axis of rotation of said pushing portions is moved with their pivotal movement to achieve their compact rotation, and said actuating portion of the pivoting member is pivotally moved toward the fitting opening of said housing to bring the contact portions of said contacts into contact with said connecting object.

4. A connector including a plurality of contacts each having one contact portion adapted to contact a connecting object, a housing arranging and holding said contacts therein and having at its upper portion a fitting opening into which said connecting object is inserted, and a pivoting member causing said contacts to be elastically deformed to push the contacts against said connecting object, wherein each of said contacts comprises a first piece having on one side of one end the one contact portion adapted to contact said connecting object and on one side of another end a pressure receiving portion adapted to be pushed by said pivoting member, a second piece having on one side of one end an extension portion extending in the direction against the inserting direction of said connecting object and on one side of another end a connection portion adapted to be connected to a substrate, and a jointing portion for connecting said first and second pieces, and wherein said contacts further comprise holding means permitting pushing portions of said pivoting member to pivotally move between said pressure receiving portions and said connection portions, wherein said pushing portions have oval shape, wherein said holding means comprises a projection provided on said pressure receiving portion of said first piece of at least every other contact to extend toward said connection portion, and a protrusion provided in the proximity of tip of the connection portion of said second piece of the at least every other contact to extend toward said pressure receiving portion, wherein said housing comprises a ceiling portion for covering the contact portions of said contacts and said pressure receiving portions, and wherein said pivoting member comprises an actuating portion for pivotally moving the pivoting member, the pushing portions continuously arranged in the longitudinal direction of said pivoting member, and anchoring holes independent from one another for receiving therein said pressure receiving portions, respectively, said pivoting member being mounted on said housing so that said pushing portions are pivotally moved between said connection portions and said pressure receiving portions of said contacts, during which pivotal movement the axis of rotation of said pushing portions is moved with their pivotal movement to achieve their compact rotation, and said actuating portion of the pivoting member is pivotally moved toward the fitting opening of said housing to bring the contact portions of said contacts into contact with said connecting object.

5. The connector as claimed in any one of claims 1 to 4, wherein said holding means further comprises a raised portion provided between the connection portion of said second piece and said jointing portion of at least every other contact to extend toward said pressure receiving portion.

6. The connector as claimed in any one of claims 1 to 4, wherein said holding means further comprises a projection provided on said pressure receiving portion of said first piece of each of some contacts to extend toward said connection portion, and a protrusion located in the proximity of a tip of the connection portion of said second piece of each of the some contacts to extend toward said pressure receiving portion, and said holding means further comprises a raised portion provided between the connection portion of said second piece and said jointing portion of the remaining contacts to extend toward said pressure receiving portion, the some contacts and the remaining contacts being alternately arranged so that said projections, said protrusions and said raised portions are arranged to be alternately staggered.

7. The connector as claimed in any one of claims 1 to 4, wherein the pressure receiving portion of said first piece is provided at its tip with an extended portion.

8. The connector as claimed in any one of claims 1 to 4, wherein said protection wall is further provided at the center of said ceiling portion or over all said ceiling portion.

9. The connector as claimed in any one of claims 1 to 4, wherein said pivoting member is formed at its longitudinal ends with slits which define plate-shaped pieces having elasticity which each include a raised portion at the end, and at both longitudinal ends of said housing there are provided fixtures each having an extended portion having elasticity formed integrally with or separately from said fixture and extending substantially perpendicular to the ceiling portion of said housing so that when said pivoting member has been closed, the raised portions of said pivoting member engage the insides of said extended portions.

10. The connector as claimed in any one of claims 1 to 4, wherein said connecting object is provided at both longitudinal ends with anchoring portions, while said pivoting member is provided with engaging projections located at positions corresponding to the anchoring portions of said connecting object and adapted to engage said anchoring portions so that when said pivoting member is closed, said engaging projections engage said anchoring portions, thereby holding said connecting object.

11. The connector as claimed in any one of claims 1 to 4, wherein said housing is provided with slits on the side to contact said pivoting member only at locations corresponding to the contacts to be inserted into the housing from the side opposite to the fitting opening.

12. The connector of claim 6, wherein when said connecting object is connected to said connector, the pushing portions of said pivoting member are successively positioned such that before connecting said connecting object to said connector, the lower ends of the pushing portions of said pivoting member are in contact with said raised portions, that, second, when said actuating portion is pivotally moved, the pushing portions are pivotally moved about centers of curvatures of the lower ends as axes of rotation, respectively, under the condition of the lower ends in contact with said raised portions so that said pushing portions assume slightly inclined positions, that, third, when said actuating portion is further pivotally moved, the pushing portions are pivotally moved about centers of said pushing portions as axes of rotation, respectively, while the lower ends of said pushing portions somewhat move from the second condition toward said connection portions so that said pushing portions assume substantially vertical positions, that, fourth, when said actuating portion is further pivotally moved, said lower ends of the pushing portions are further moved from the third condition toward said connection portions and upper ends of said pushing portions move toward said projections so that said pushing portions assume vertical positions, that, fifth, when said actuating portion is further pivotally moved, said lower ends further move from the fourth condition toward said connection portions and the upper ends of said pushing portions come into contact with said projections, and that, finally, when the actuating portion of the pivoting member is further pivotally moved from the fifth condition, said pushing portions are pivotally moved about centers of curvatures of said upper ends as axes of rotation, respectively, whereby the contact portions of said contacts are brought into contact with said connecting object by pivotally moving said pivoting member toward the fitting opening of said housing.

* * * * *